US012140399B2

(12) United States Patent
Petrarca et al.

(10) Patent No.: US 12,140,399 B2
(45) Date of Patent: Nov. 12, 2024

(54) SOAP FOAM BLASTER DEVICE

(71) Applicant: Little Kids, Inc., Seekonk, MA (US)

(72) Inventors: Michael Petrarca, Chepachet, RI (US); Michael Fusco, Greenville, RI (US)

(73) Assignee: Little Kids, Inc., Seekonk, MA (US)

( * ) Notice: Subject to any disclaimer, the term of this patent is extended or adjusted under 35 U.S.C. 154(b) by 0 days.

(21) Appl. No.: 18/185,336

(22) Filed: Mar. 16, 2023

(65) Prior Publication Data

US 2023/0296348 A1 Sep. 21, 2023

Related U.S. Application Data

(60) Provisional application No. 63/320,872, filed on Mar. 17, 2022.

(51) Int. Cl.
*F41B 9/00* (2006.01)

(52) U.S. Cl.
CPC ..... *F41B 9/0028* (2013.01); *F41B 9/0071* (2013.01); *F41B 9/0081* (2013.01)

(58) Field of Classification Search
CPC .... A63H 33/28; A63H 23/10; B05B 11/1087; B05B 11/02; B05B 7/0018; A47K 5/14; F41B 9/0028; F41B 9/0071; F41B 9/0081; F41B 9/0037
See application file for complete search history.

(56) References Cited

U.S. PATENT DOCUMENTS 2,090,727 A 8/1937 Gosman
3,925,923 A * 12/1975 La Fata ..... A63H 33/28 446/18
3,946,947 A 3/1976 Schneider
4,603,812 A 8/1986 Stoesser
5,230,648 A 7/1993 Kelly
6,138,875 A 10/2000 Condon
7,086,612 B2 8/2006 Crawford
7,281,642 B2 10/2007 Orlowski
8,075,363 B2 12/2011 Gomzar
8,231,111 B2 7/2012 Chang
8,783,517 B2 7/2014 Malik
9,694,299 B1 * 7/2017 Kouso ..... A63H 33/28
9,861,942 B1 1/2018 Paul
10,029,266 B2 7/2018 Gantenbaum
(Continued)

*Primary Examiner* — Vishal Pancholi
*Assistant Examiner* — Robert K Nichols, II
(74) *Attorney, Agent, or Firm* — Hinckley, Allen & Snyder, LLP; David R. Josephs

(57) ABSTRACT

The invention is directed to a soap foam blaster device with a switch (or trigger) actuated pump to create soap foam using an aerator that is directed into a telescoping breech for pressurization thereof. A grip member with a nozzle on the free end thereof is attached to an inner member and actuated rearwardly to collapse the breech thereby launching the soap foam a substantial distance for targeted direction of soap foam for improved gameplay. For another blast of foam soap, the telescoping breech is expanded again by moving the grip member forwardly to slide out the inner member within the outer member whereby another volume of soap foam can be loaded into the breech for a subsequent launch. Alternatively, soap foam solution may be manually pumped from the soap solution reservoir by a manual telescoping pump configuration to create foam and then manually launched therefrom through the outer nozzle.

4 Claims, 29 Drawing Sheets

(56) References Cited

U.S. PATENT DOCUMENTS

| | | | | |
|---|---|---|---|---|
| 2004/0001550 | A1 | 8/2004 | Dunham | |
| 2009/0188994 | A1* | 7/2009 | Ray | B05B 11/1098 222/190 |
| 2009/0294478 | A1* | 12/2009 | Ciavarella | B05B 11/1087 222/207 |

* cited by examiner

SOAP FOAM BLASTER DEVICE

CROSS REFERENCE TO RELATED APPLICATION

This application is related to, and claims benefit from, U.S. Provisional Application No. 63/320,872, filed on Mar. 17, 2022, entitled "SOAP FOAM BLASTER DEVICE," incorporated by reference in its entirety, herein.

BACKGROUND OF THE INVENTION

The invention is in the field soap bubble and soap foam producing toys, that may or may not be motor-driven or partially motor-driven. The present invention is particularly related to toys that generate soap foam with a voluminous flow and in a targeted fashion.

Soap bubble and foam producing toys, that may or may not be motor-driven or partially motor-driven have been around for many years. Typically, such toys have a soap solution reservoir, a motive power source, for example, a battery, a motor, a pump, a soap foam/bubble solution feed tube, and a soap bubble forming structure, such as a wand or wand-like circular aperture for forming the soap bubbles. It should be understood that toys that generate soap foam and soap bubbles are highly related in that they both create structures made of soap for play but they are different. First, soap "bubbles" are discrete structures filled with gas (e.g. air) trapped in film shell of soap. On the other hand, "foam" is also formed by trapping pockets of gas in a liquid or solid, such as air trapped in a shell or walls of soap. In most foams, the volume of gas is large, with thin films of liquid or solid separating the regions of gas rather than discrete and separate structures filled with gas. Soap foams are also commonly known as suds. The device of the present invention has particular use in generating soap foam but could also be modified to create soap bubbles. The discussion herein and below will focus on the creation of soap foam with the device of the present invention.

In the prior art, these soap foam producing toys commonly include a soap solution delivery or dispensing structure and a blower that blows air into or mixes air into the soap solution to drive the soap solution into and through an aerator fabric, mesh or screen material, or the like, to introduce air into the soap solution to, thereby, transform the liquid soap solution into an air-filled sudsy foam material, which is outputted from the machine for use and play.

Also, such prior art soap foam machines and devices are configured to create a constant flow of soap foam, typically with the goal of creating large volumes of soap foam for a given type of gameplay. These prior art soap foam generating machines and devices create such soap foam in a non-directed fashion, such as where the soap foam simply exits the machine or device and flows onto the surface in front of the machine or device so it can be played with or picked up and then played with.

There are prior toy devices that can shoot some type of material, for example water, in a targeted fashion toward another for a different type of game play. This would be similar to shooting a water pistol toward another where the fun is sending the material toward someone else from a remote location. However, such a target-oriented launching of soap foam is not possible with current machines and devices because they are incapable of sending, shooting or launching the generated soap foam a distance away from the user toward a target, such as another person. Thus, gameplay of current soap foam generating machines and devices are limited to simply generating large volumes of soap foam.

There is a need in the industry for a machine or device that can produce large volumes of quality soap foam to maximize fun and enjoyment by the user.

There is a further need to for a machine or device that can launch or shoot generated soap foam over a distance for targeted delivery to a remote location.

SUMMARY OF THE INVENTION

The invention provides an improved device for generating soap foam that includes a manual or mechanical pump. For example, the pump may be electrically powered by an electrical source that may be actuated by an ON/OFF switch, which may be in the form of a trigger or other configuration or mechanism. More specifically, the pump is preferably a diaphragm pump with an eccentric shaft, that pumps concentrated soap foam solution from a reservoir. Alternatively, the soap foam solution may be pulled from or pumped from the storage reservoir by a manual telescoping pump configuration where extending a telescoping pump effectuates the pumping action.

Whether electrically powered or manually carried out, the soap foam solution is pulled through an internal valve assembly, mixes it with air, preferably by routing it through aerator with a specially configured nozzle, to create soap foam.

The newly created soap foam is then preferably directed/pumped into a launch chamber or structure that can be of a tubular shape or any other configuration, shape, or construction, with a telescoping configuration with a grip member, with a nozzle on the free end thereof, attached to the sliding inner tube. As a result of the filling with soap foam, the chamber is pressurized. Pulling of the grip member of the device rearwardly to collapse the telescope pump structure causes the breech chamber to collapse/compress and soap foam to be driven in pressurized through the outer nozzle in the grip member with enough pressure so it can be launched a substantial distance for targeted direction of soap foam for added fun and enjoyment of the device.

Therefore, an object of the invention is to provide a device that can produce large volumes of quality soap foam to maximize fun and enjoyment by the user.

Another object of the invention is to provide a device that can launch or shoot generated soap foam over a distance for targeted delivery to a remote location.

BRIEF DESCRIPTION OF THE DRAWINGS

The novel features that are characteristic of the present invention are set forth in the appended claims. However, the invention's preferred embodiments, together with further objects and attendant advantages, will be best understood by reference to the following detailed description taken in connection with the accompanying Figures in which:

DETAILED DESCRIPTION OF THE PREFERRED EMBODIMENT

Figure 1:
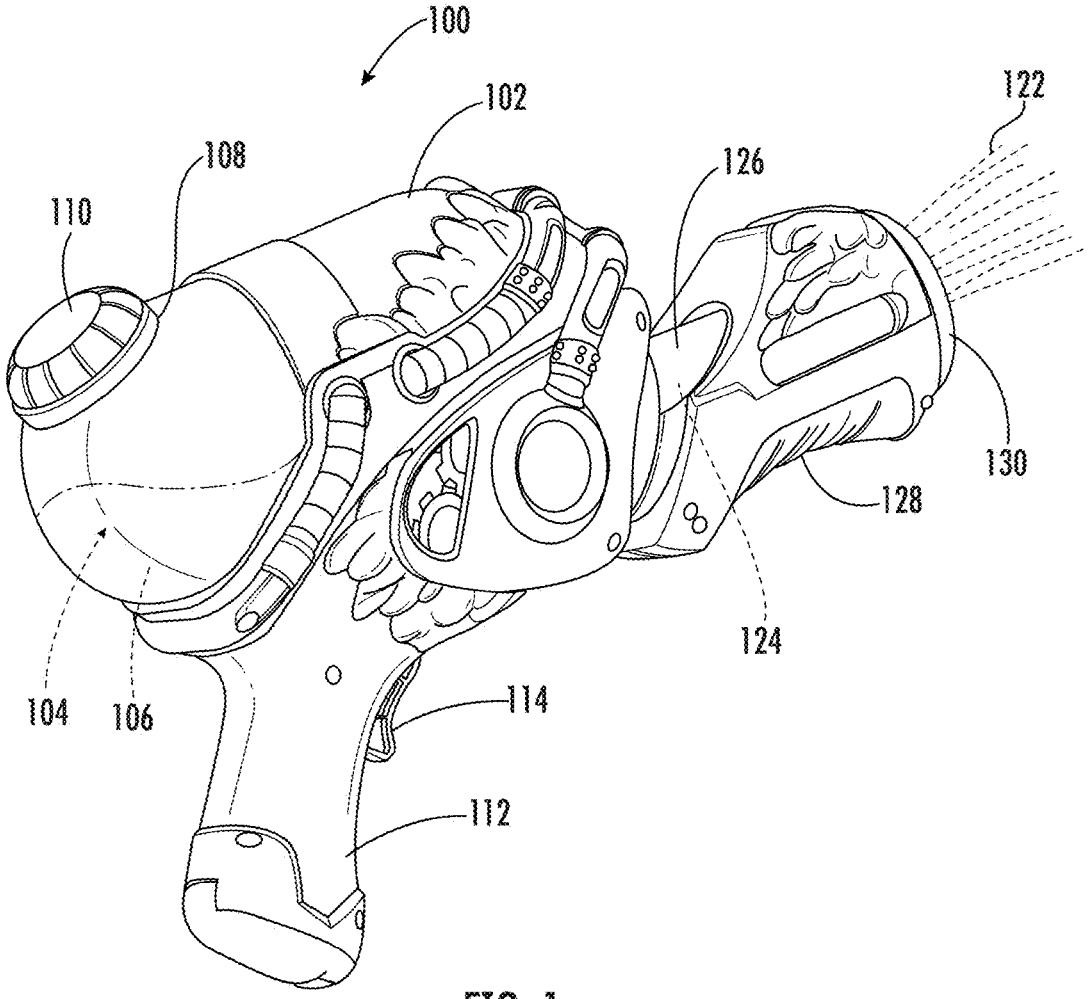
FIGS. 1-7 show various view of the exterior of the present invention.
Figure 2:
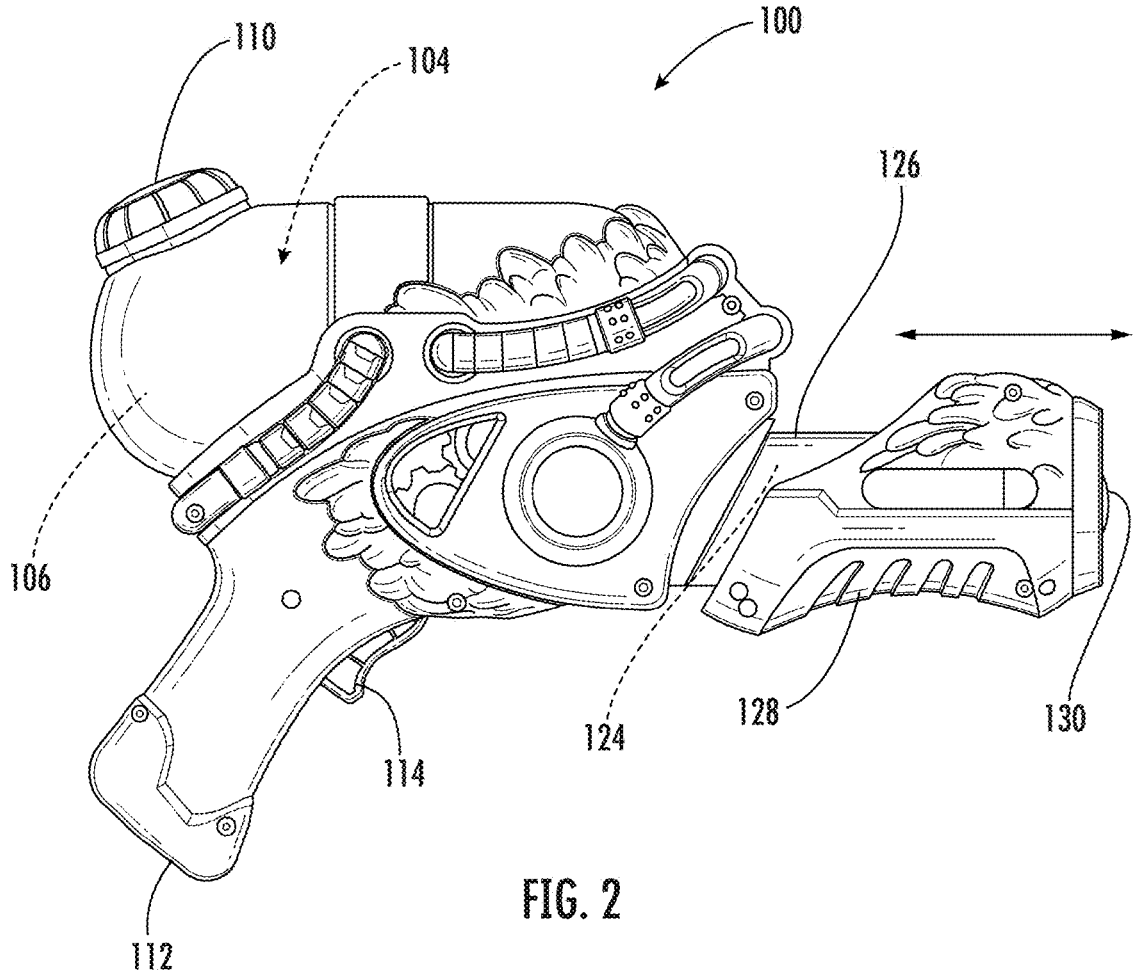
Figure 3:
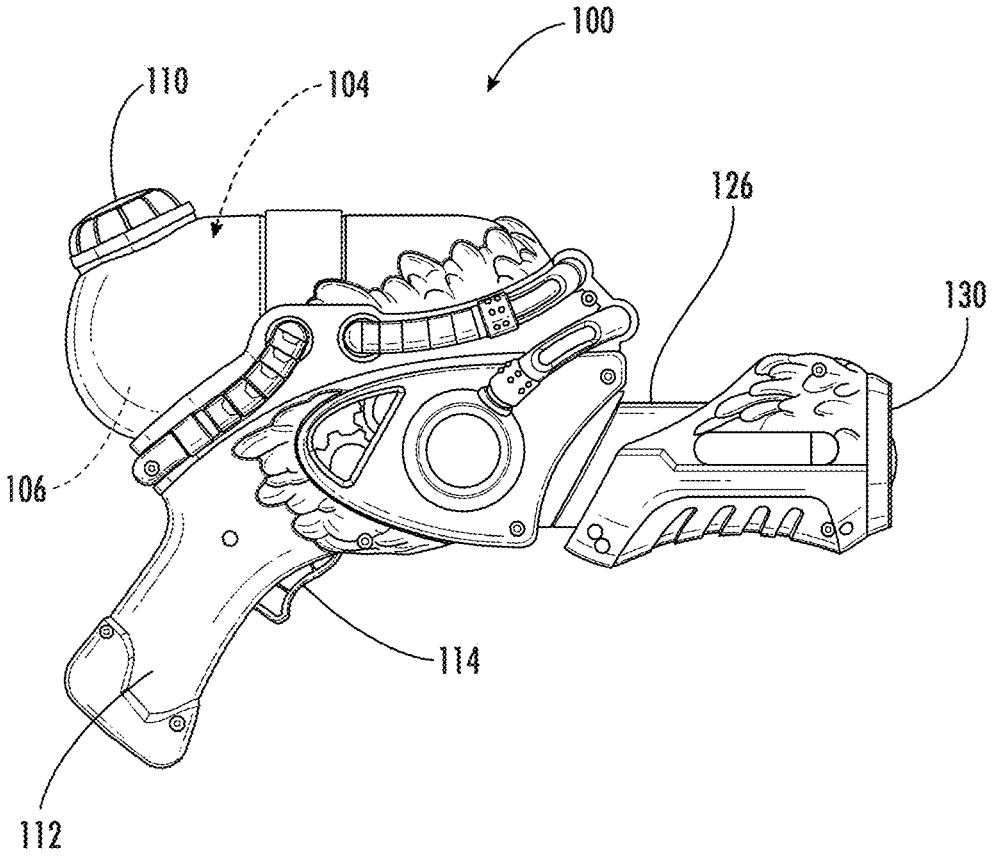
Figure 4:
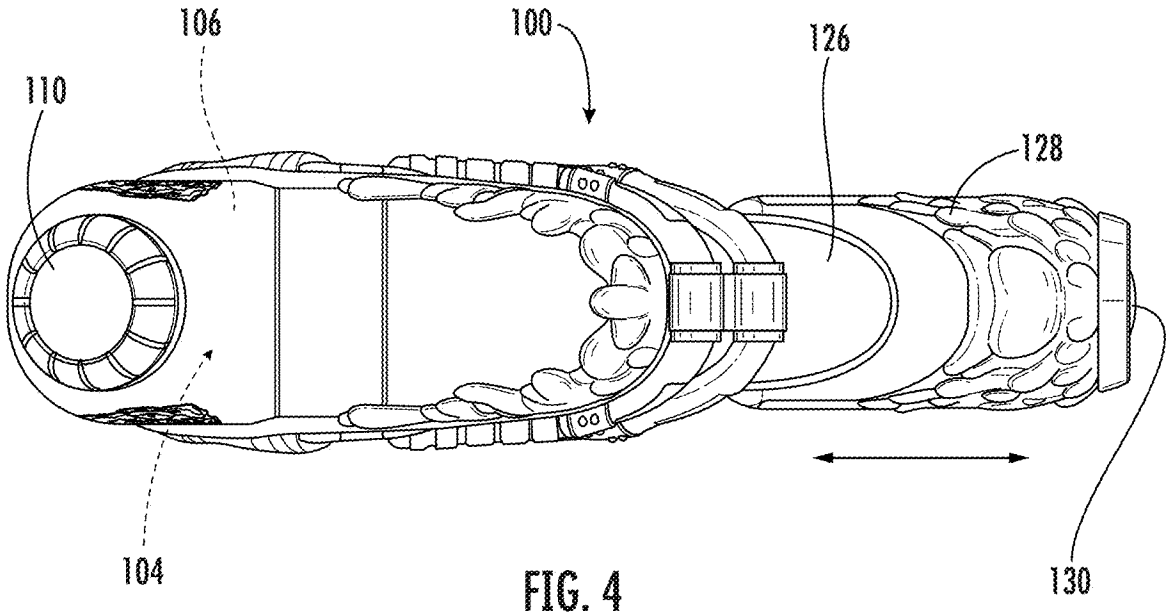
Figure 5:
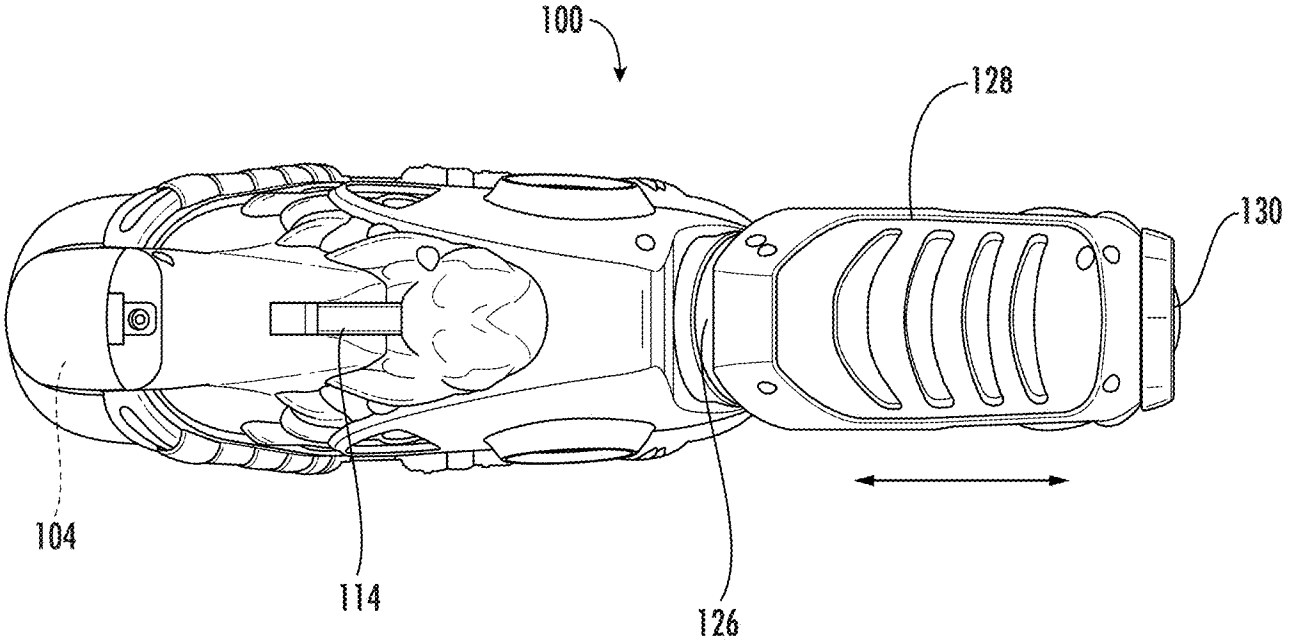
Figure 6:
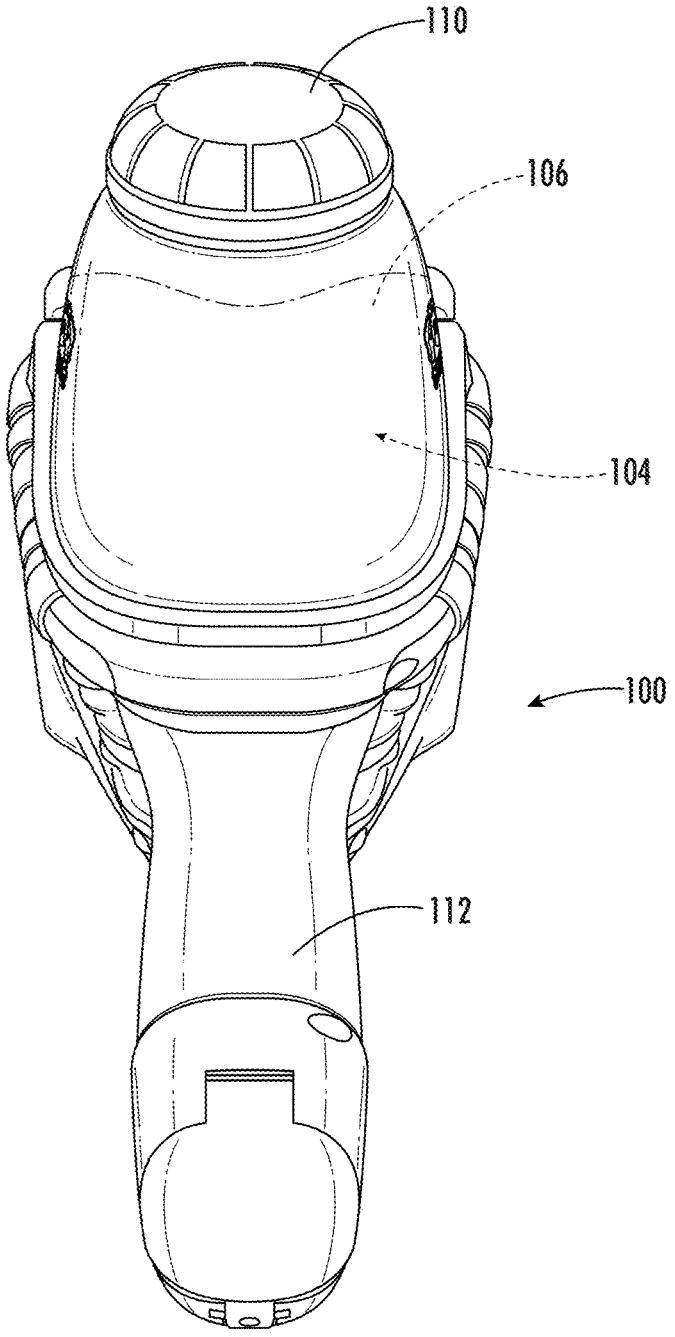
Figure 7:
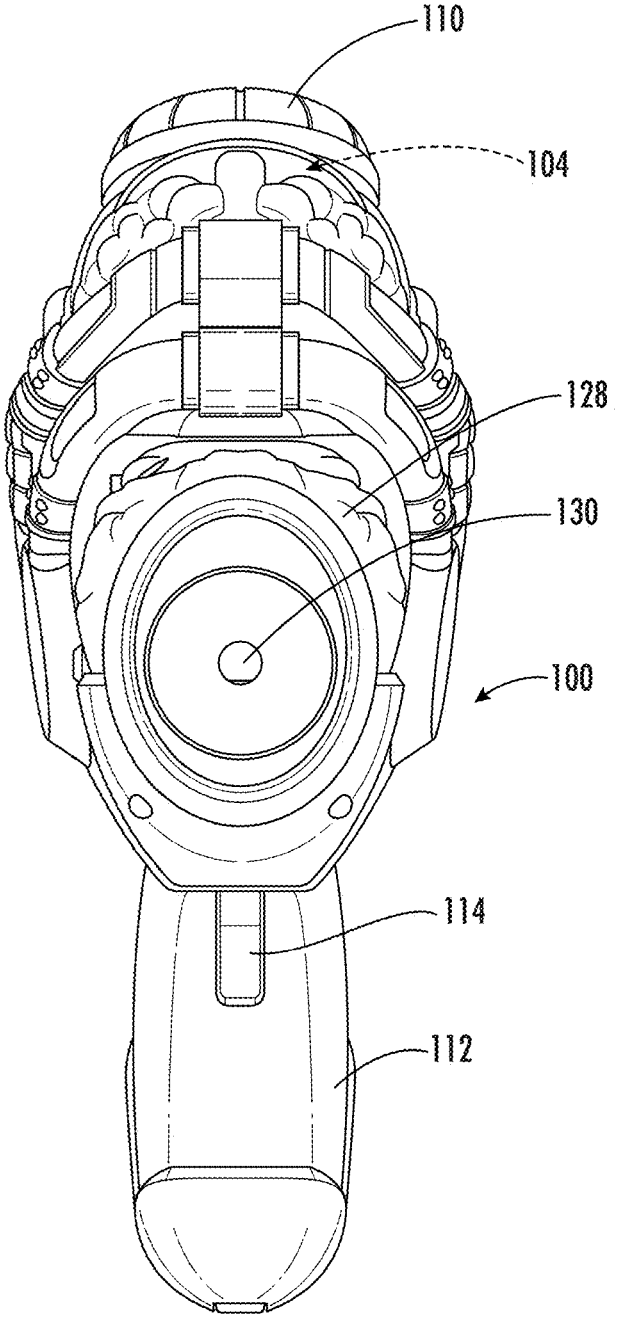
Figure 8:
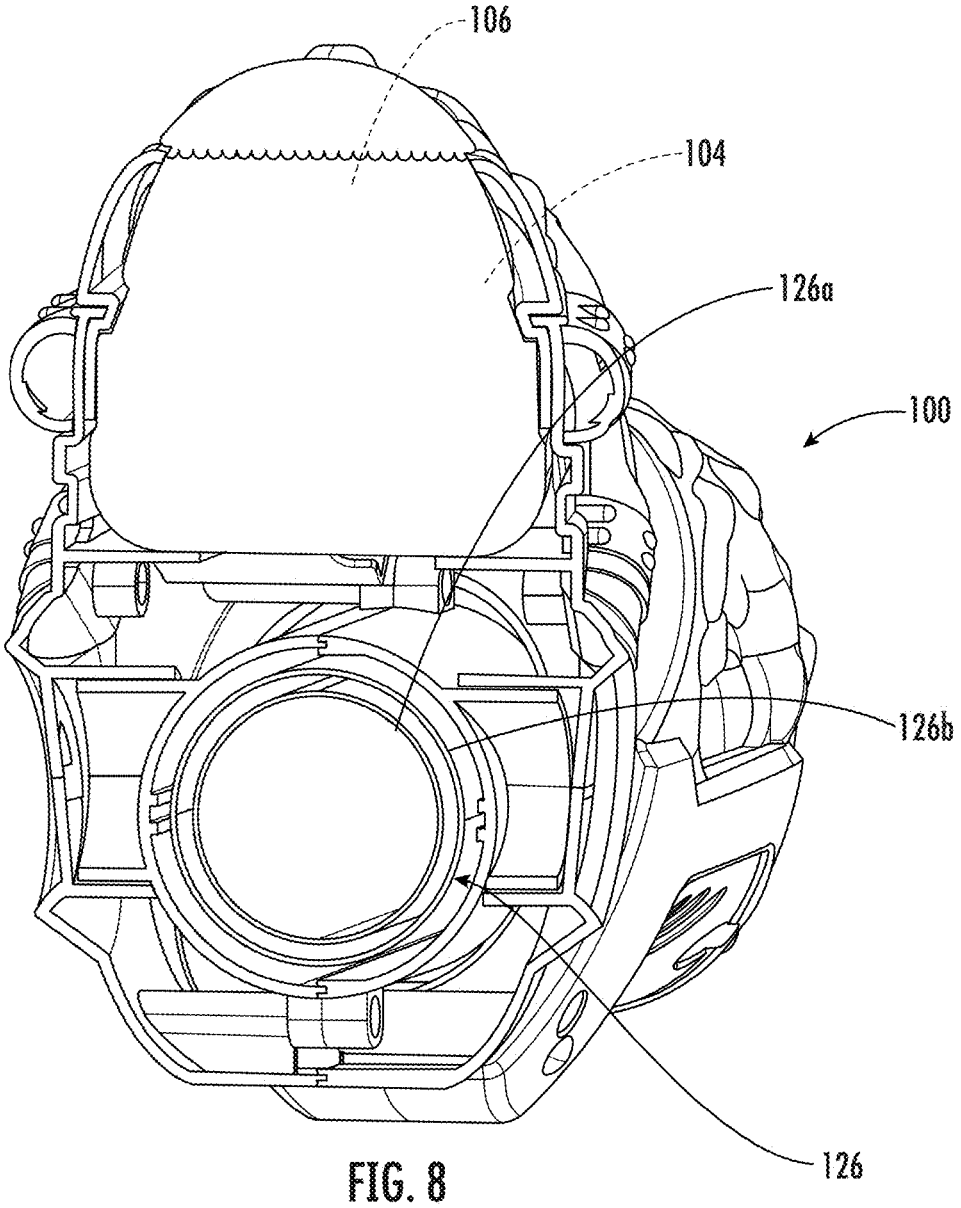
FIG. 8 shows a longitudinal cross-sectional of the present invention through FIG. 4.

The new and unique soap foam blaster device of the present invention generates large volumes of soap foam and can launch the generated soap foam a given distance toward a target, such as 10 to 15 feet, as described in detail below.

Turning first to FIGS. 1-8, the outer configuration of a first embodiment 100 the present invention is shown in detail. A main body 102 is provided with a soap foam solution storage reservoir 104 where the soap foam solution 106 is poured into the reservoir via an opening 108 and is closable with a cap 110. A handle 112 with a switch actuator 114, in the form of a trigger for example, is a provided whereby the trigger 114 is electrically connected to a pump 116, with a pump cover 117, such as a diaphragm pump with an eccentric shaft, that pumps concentrated soap foam solution 106 from the reservoir 104, mixes it with air, preferably by driving it through an aerator 118 with a specially configured nozzle 120, to create soap foam, as discussed in detail below.

In general, the created soap foam 122 is then directed/pumped into a chamber "breech" 124 of a member with a telescoping configuration, which is preferably of a tubular configuration but may be of other shapes and configurations, if desired. For example, the telescoping tubular member 126 preferably includes an inner tube 126*a* that slides within an outer tube 126*b*. A grip member 128 with a nozzle 130 on the free end thereof is attached to the inner tube 126*a*. As a result of the filling with soap foam 122, the chamber 124 is pressurized. Pulling of the grip member 128 of the device rearwardly causes the telescoping tube 126 to collapse/compress and the soap foam 122 to be driven through the nozzle 130 in the grip member 128 with enough pressure so it can be launched a substantial distance for targeted direction of soap foam 122 for improved gameplay and fun. Upon a single stroke of the grip member 128 rearwardly and collapsing/compressing of tubular member 126, the breech 124 is emptied of soap foam 122 due to the pressurized chamber 124 and launching operation and collapsing/compressing of the breech 124.

Figure 9:
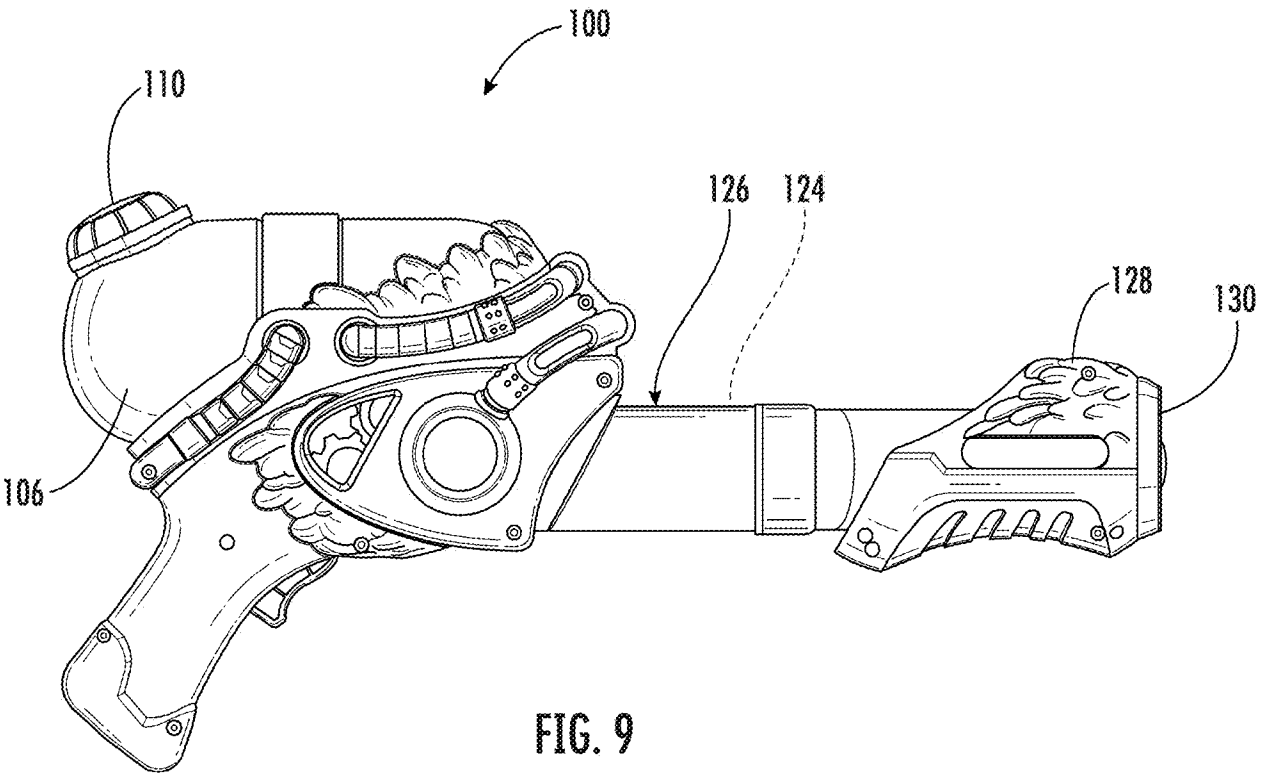
FIG. 9 with the chamber in an extended condition.
Figure 10:
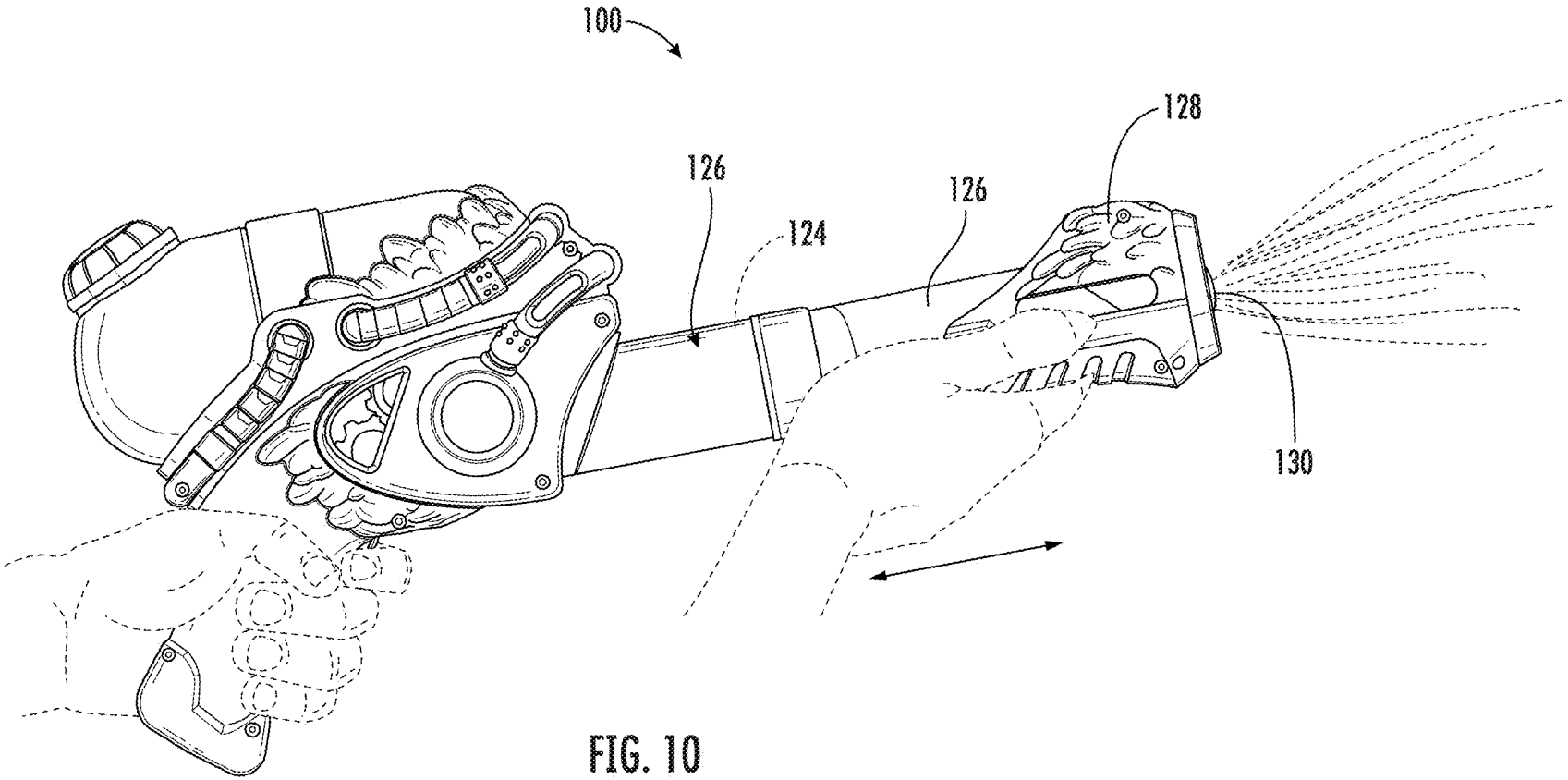
FIG. 10 is a side view of device in the process of being actuated to launch the soap foam loaded into the chamber.
Figure 11:
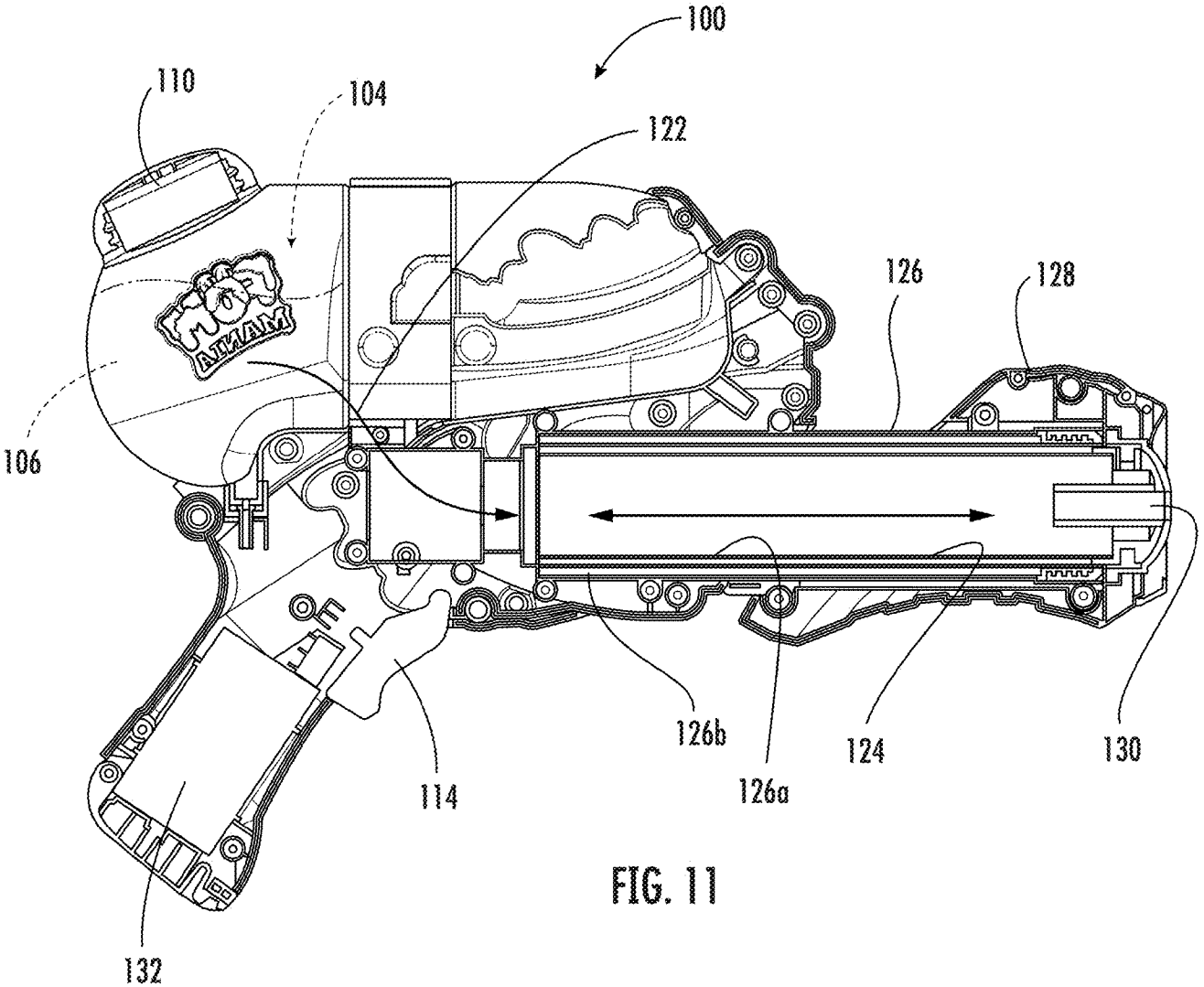
FIG. 11 is a transverse cross-sectional view through FIG. 2.
Figure 12:
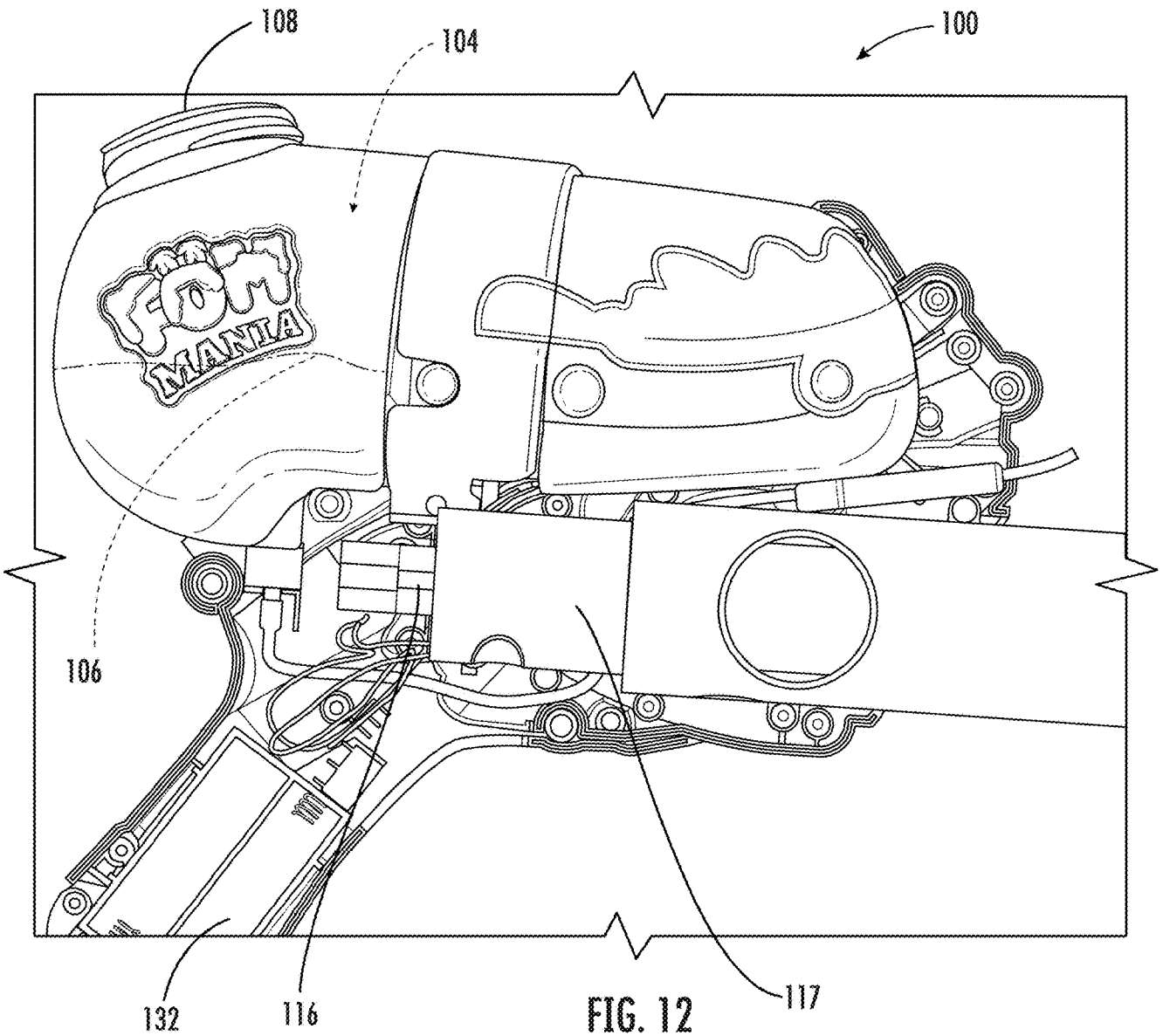
FIG. 12 is a close-up view of the diaphragm pump with outer housing removed for illustration purposes.
Figure 13:
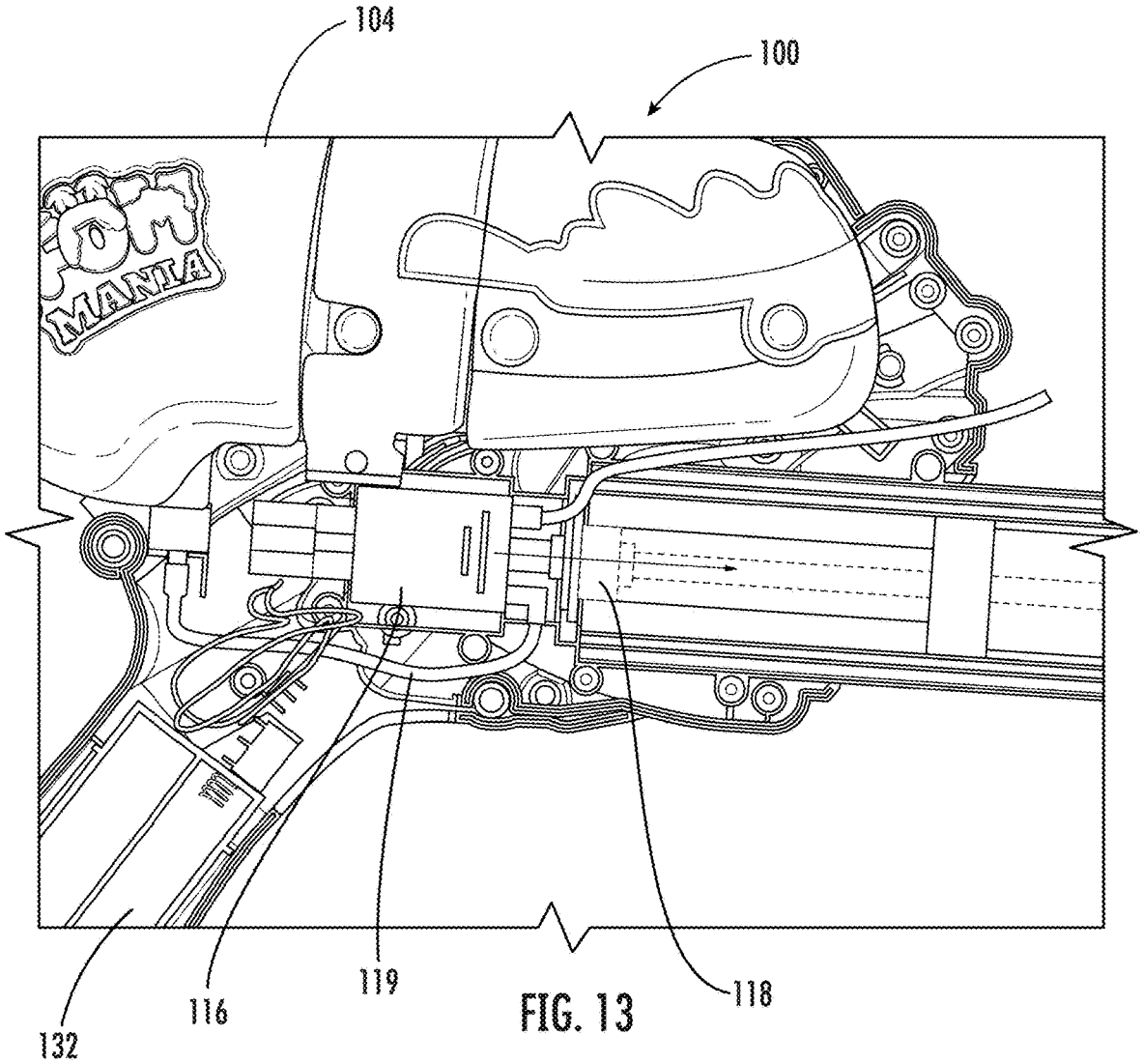
FIG. 13 is a close-up view of the diaphragm pump of FIG. 12 with internal pump cover removed for illustration purposes.
Figure 14:
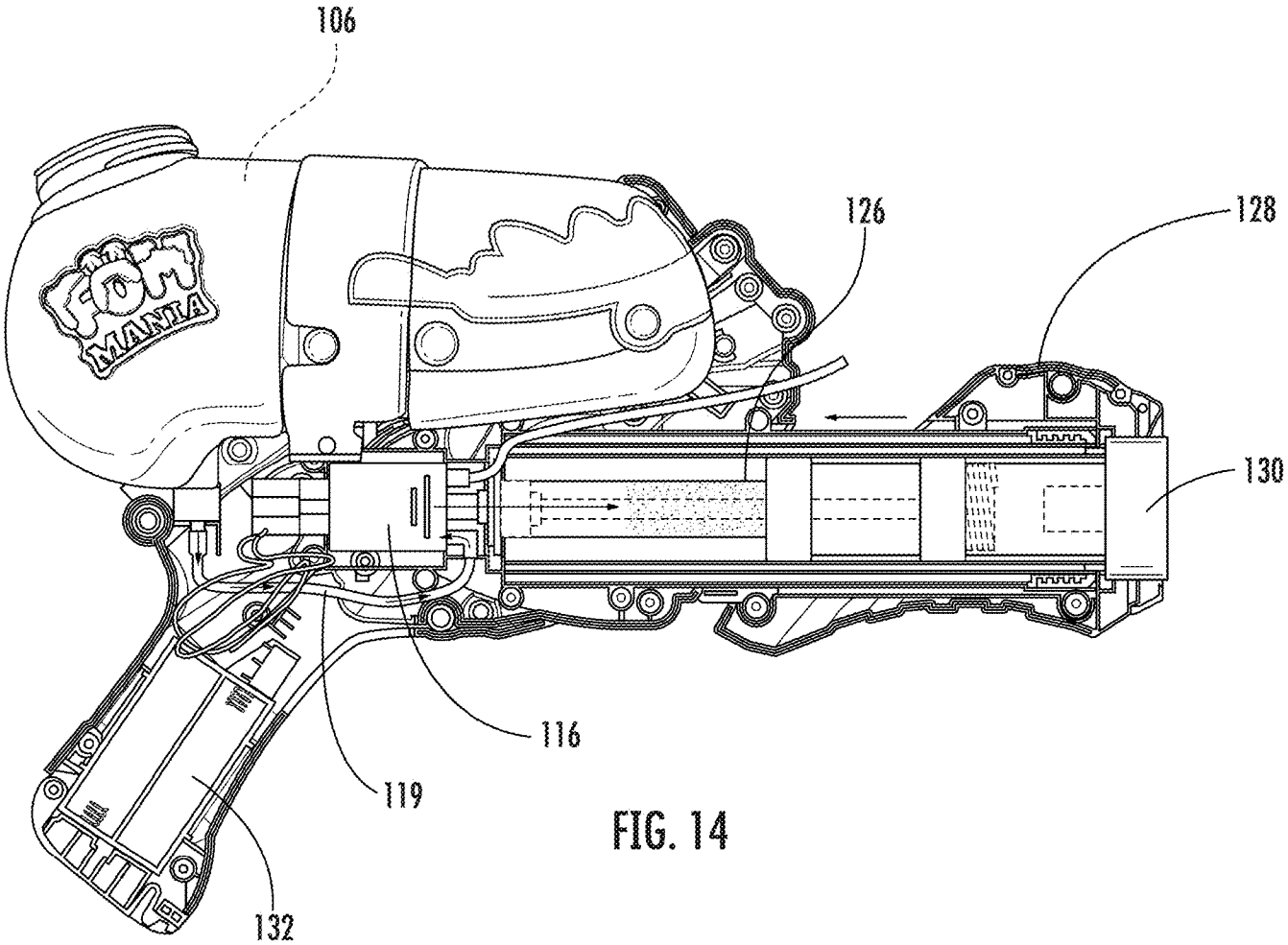
FIG. 14 is a full view of the internal pump mechanism of the present invention.

Next, the grip member 128 is moved forwardly, as seen in FIGS. 9 and 10 in the opposite direction so the tubular member 126 expands into an extended position, thereby expanding and opening the breech 124 again to open the chamber 124 back up for the receipt of the next volume of soap foam 122 created by the pump using the soap foam solution 106 from the reservoir 104 and aerator 118, as best seen in FIG. 13. Upon filling (or partial filling) of the breech 124 again with new soap foam 122 by trigger-actuated pumping of soap solution 106 through the aerator 118, the grip member 128 is again actuated rearwardly to launch the volume of soap foam 122 residing in the breech 124. The process is repeated for launching of multiple volumes of soap foam 122, as can be seen in FIGS. 9 and 10.

FIG. 11-14 show details of the internal components of the soap foam blaster device 100 of the present invention, namely, the switch (trigger) actuated pump and aerator 118 to create soap foam 122. As can be generally seen in FIG. 11, the generated soap foam 122 is directed into the chamber or "breech" 124 of the telescoping (e.g. tubular) member 126 for pressurization and then launched upon rearward actuation of the grip member 128 for collapsing of the telescoping tubular member 126, as discussed above.

More specifically, as seen in FIGS. 11-14, the diaphragm pump 116 is electrically connected to the switch (trigger) 114 so when the trigger 114 is depressed, the pump 116 is turned on to thereby pump solution 106 from the reservoir, through a supply tube 119, to push it through the aerator 118 for the desired introduction of air to create foam 122 of the desired characteristics and then into the chamber/breech 124. For example, battery compartment/supply 132 can be included to provide power for the pump 116. The foam 122 then resides in the breech 124 awaiting launch by rearward actuation of the grip member 128 and collapsing of the telescoping tubular member 126.

It should be noted that since the soap foam blaster device 100 of the present invention is of a gun-like configuration with an exit nozzle 130 that shoots a controlled and directed stream of soap foam 122. It is well suited for launching soap foam 122 toward a target with accuracy, which is not possible in prior art soap foam generating machines and devices. For example, it is preferred that the device 100 of the present invention can launch soap foam 122 a distance in the range of 10 to 15 feet but it can be modified for distances more or less than that. The characteristics, size, features and configuration of the soap solution 106, aerator 118, pump 116, nozzle 130 in the grip member 128 and other components are selected so that a soap foam 122 can be properly generated and launched using the device 100 of the present invention. For example, such a configuration can be modified to provide launched foam 122 of a given nature and a given travel distance to suit the application at hand. For example, the pump 116 is preferably an electrically powered diaphragm pump but other pumps 116 may be employed and still be within the scope of the present invention including other electrically-powered pumps. The pump 116 may also manually powered whereby manual actuation by the user would provide the required pumping without the need for an electrical power source, where any suitable manual pump construction or configuration is used for this purpose.

Figure 15A:
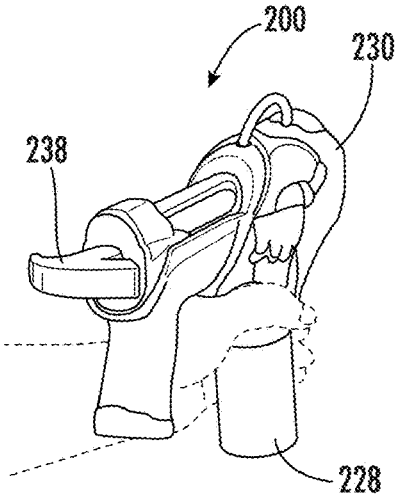
FIGS. 15A-E show an alternative embodiment of the present invention where the mechanical features therein are used with a manual pump to fill the breech with foam soap for launching.
Figure 15B:
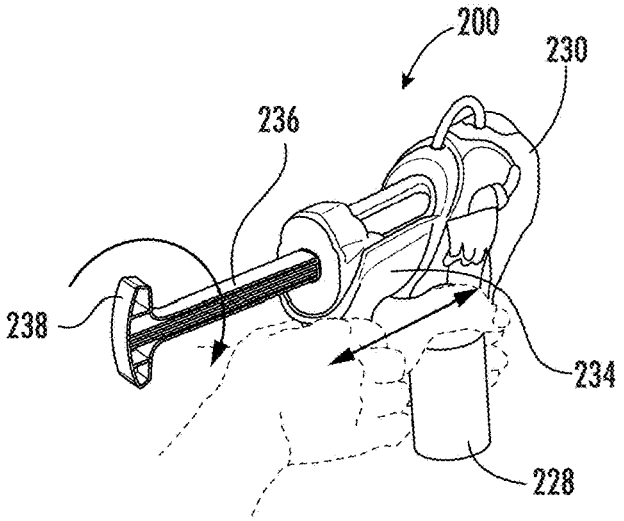
Figure 15C:
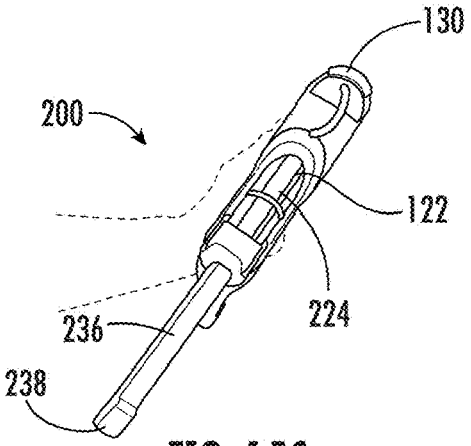
Figure 15D:
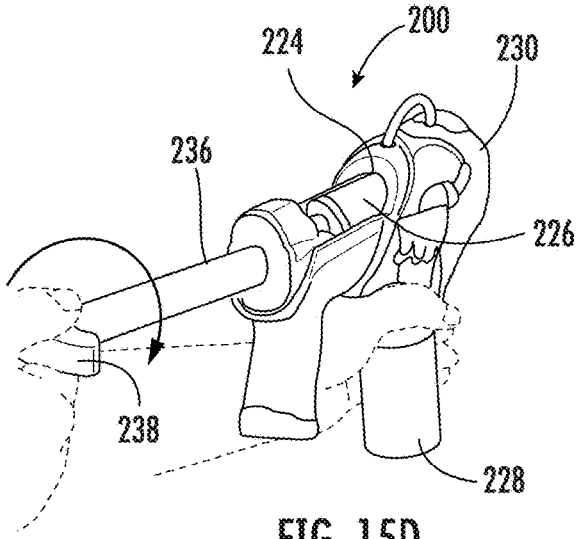
Figure 15E:
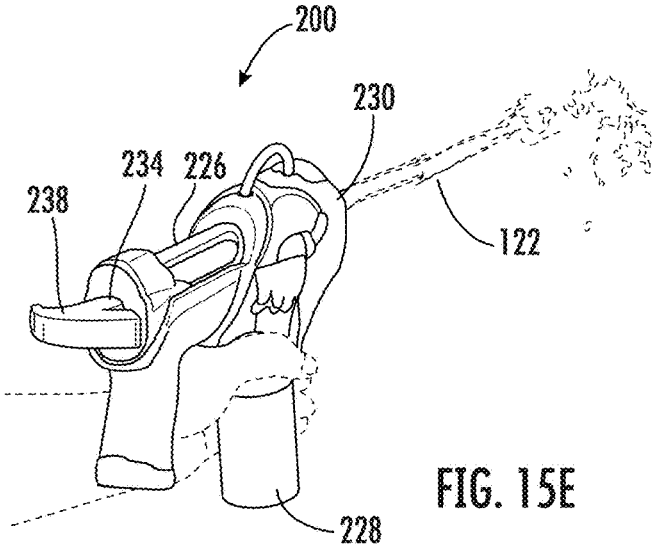

FIGS. 15A-E show an alternative embodiment 200 of the present invention where the mechanical features therein are used with a manual pump 234 to fill the breech 224 with soap foam 122 for launching. More specifically, FIG. 15A shows a soap foam generating blaster device 200 that generally has the same components as the preferred embodiment 100 of the present invention. However, a manual pump 234 is used to fill the breech 224 with soap foam 122 for launching, as can be seen in FIG. 15B where the manual pump 234 includes an armature 26 with a pull handle 238. A tube body 226, having a sliding inner member that is put under pressure via an elastic material. A grip member 228 has a nozzle 230 on the free end of the tube body 226. The tube body 226, that defines a breech chamber 224 therein, is provided where the elastic (forward spring-biased) sliding inner member 226 is either in a resting state or pulled back and put under pressure, as in FIG. 15D. A reservoir of soap foam solution is provided in the handle 228. The grip member 238 and sliding member 236 are preferably rotated 90 degrees, as in FIG. 15B, to lock the sliding member 236 in place to hold the breech open 224. A manual pump 234, that is preferably actuated by a trigger-like member to move a body back and forth for manual pumping, as seen in FIG. 15B, is provided to pump soap foam solution 206 through an aerator (not seen in FIGS. 15A-E) to create soap foam 122 and directing the soap foam into the breech chamber 224 for pressurization by the sliding piston 236 thereof. The created soap foam 122 that is ready for launch can be seen through the clear window of the breech area 224, as in FIG. 15C. As in FIG. 15D, rearward actuation of the inner member 236 by the rear pull handle 238 (and rotation of the slide member to unlock it) causes the sliding piston 236 to come under pressure, whereby releasing the handle 238 and rotating it, unlocks it and then release thereof forces the piston 236 to travel forward with the assistance of the forward spring-biasing to compress the breech 224 chamber thereby causing the soap foam 122 to be launched from the device 220 through the nozzle 230 to a target a distance away from the device 200, as shown in FIG. 15E.

Figure 16:
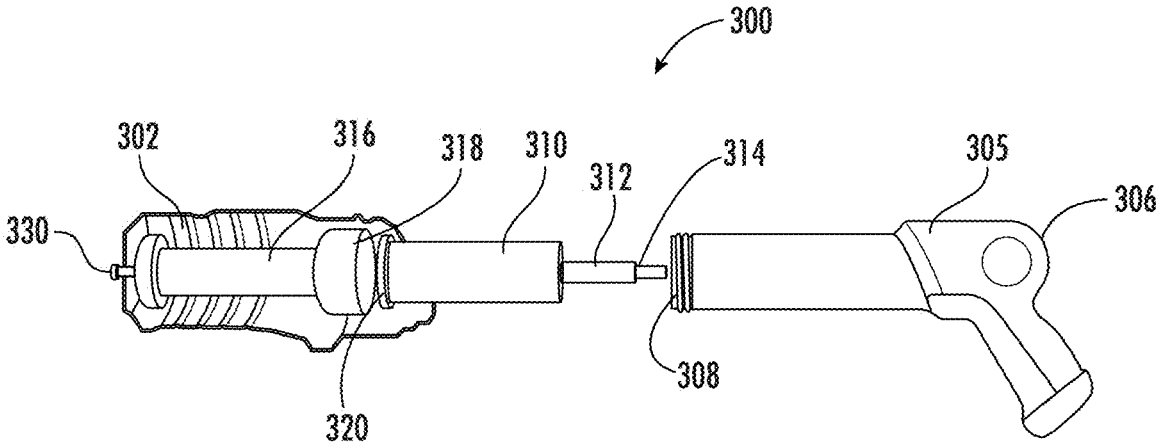
FIG. 16 is a further alternative embodiment of the present invention where the mechanical features therein are used with a manual pump to launch foam with every pump rearward with the front housing.
Figure 17A:
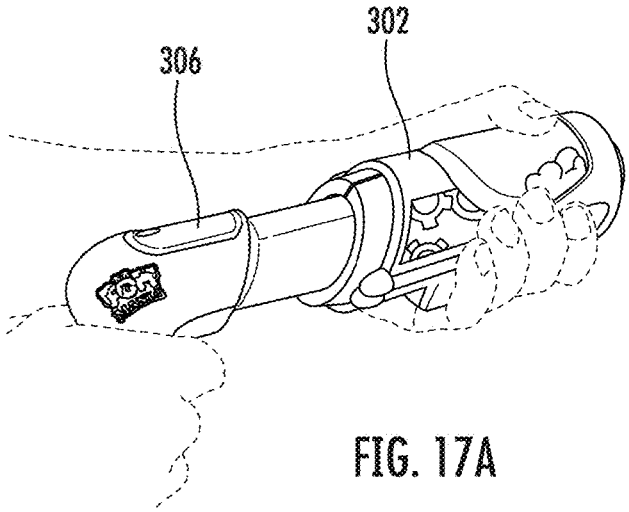
FIGS. 17A, 17B show the embodiment of FIG. 16 in use.
Figure 17B:
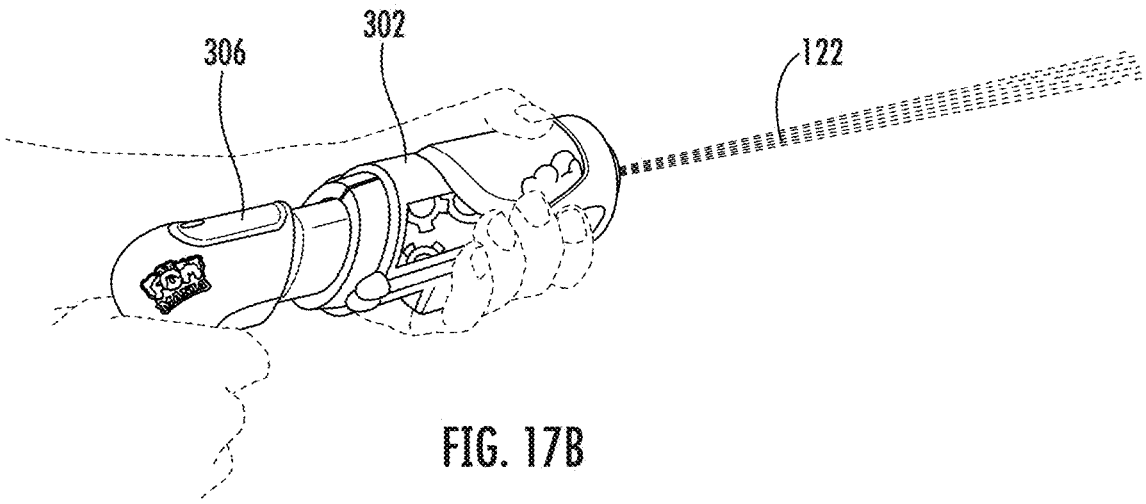

FIG. 16 is another alternative embodiment 300 of the soap foam blaster device that shows simplified design whereby the secondary elastic piston action is removed to allow for foam shooting with each pump of the front housing 302. A solution bottle or reservoir 304 inside a main housing 306 is provided with an open front end 308 that receives a pump chamber 310 that is spring-biased by a spring 312 with a ball check valve 314. A housing 306 is provided that includes a pump stroke member 316 with a cap 318 that interfaces with the pump chamber 310 to pump soap foam 122 through a spray nozzle 330. Thus, rearward sliding of front housing 302 compresses, forcing the solution 306 through the aerators 320 which shoots foam out the front nozzle 330. In this embodiment, only the nozzle 330 is in line with the pump 3 10, and the handle main housing 306 operates as a solution reservoir. FIG. 17A shows the device 300 in preparation for launch of foam 122. FIG. 17B shows rearward sliding of front housing (grip portion) 302 compresses, thereby forcing the solution 306 through the aerators 320 which shoots foam 122 out the front nozzle 330.

Figure 18A:
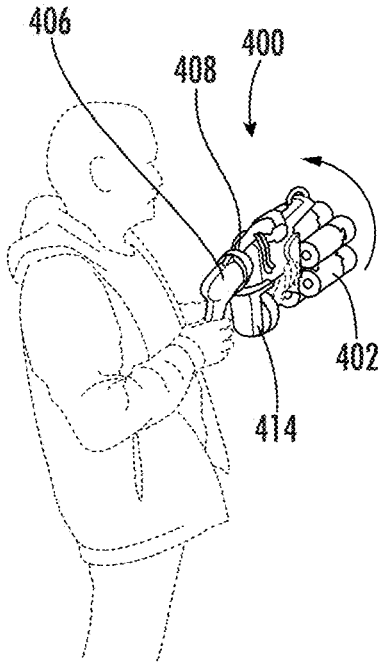
FIGS. 18A-D show another alternative embodiment of the present invention where the mechanical features of the present invention are used with an indexing barrel where soap foam is directed into a projectile for launching the projectile while carrying the soap foam therein.
Figure 18B:
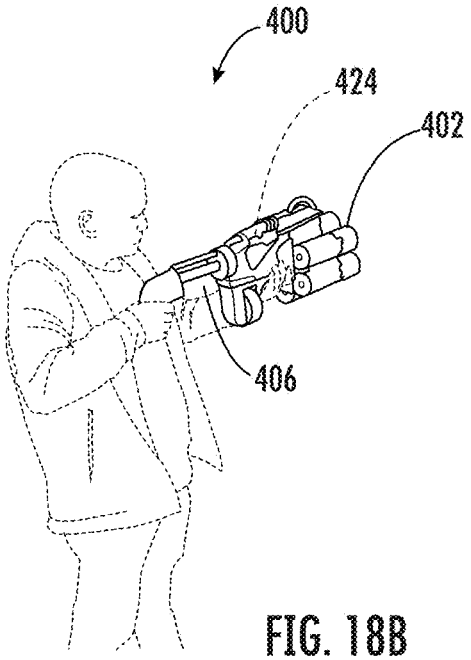
Figure 18C:
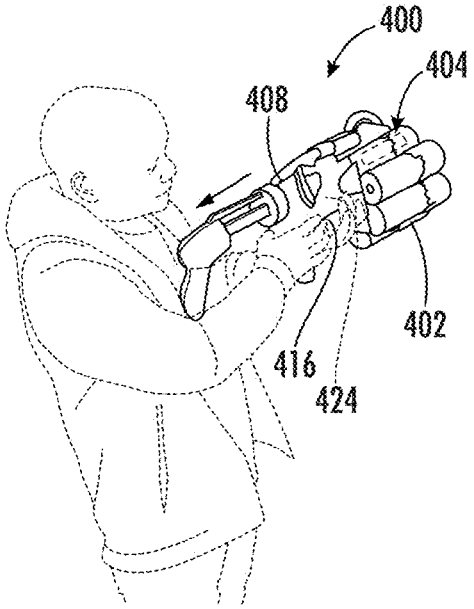
Figure 18D:
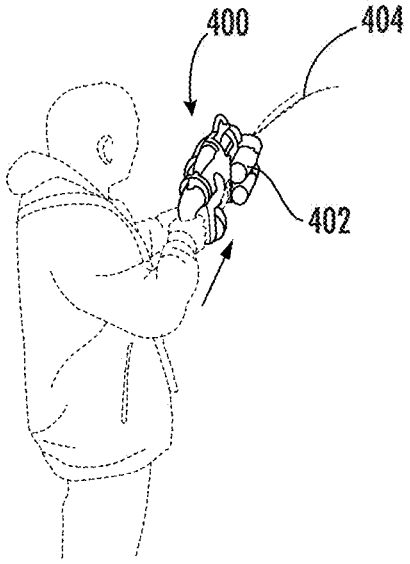
Figure 19A:
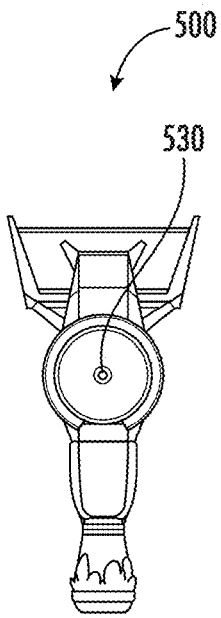
FIGS. 19A, 19B and 20A, 20B show different views of an alternative embodiment of the device shown in FIGS. 18A-D that can operate in two different modes.
Figure 19B:
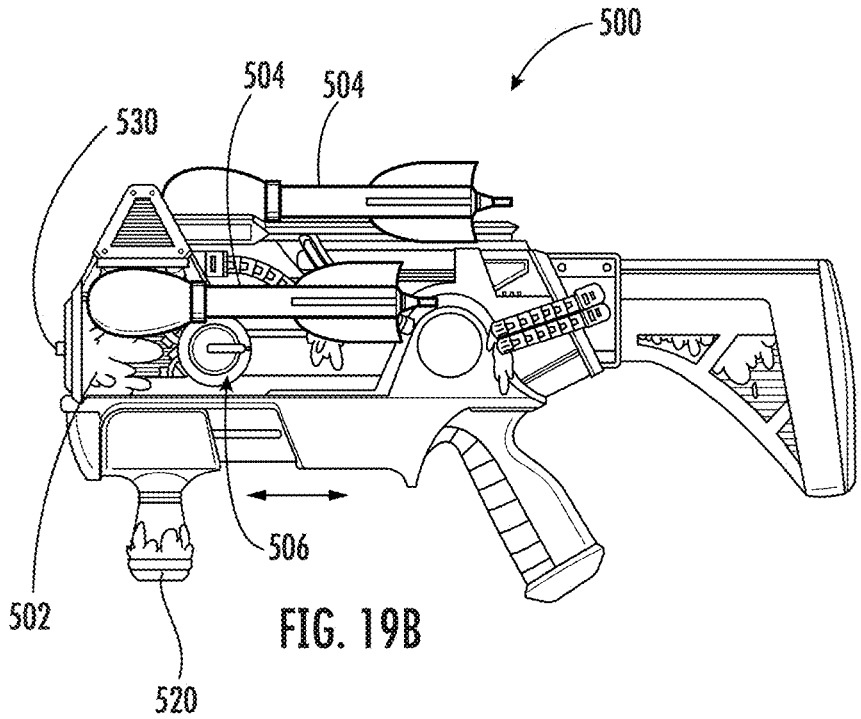
Figure 20A:
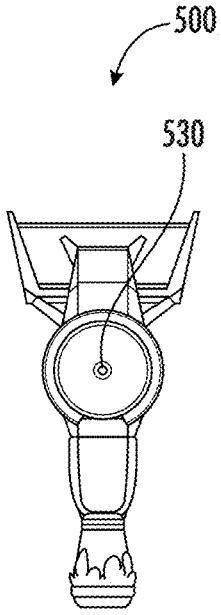
Figure 20B:
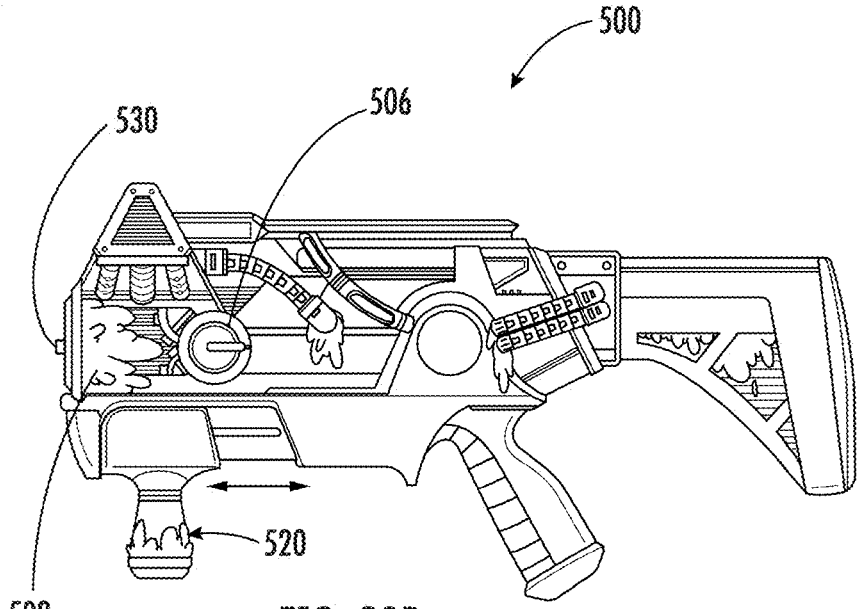

FIGS. 18A-D show another alternative embodiment 400 of the present invention where the mechanical features of the present invention are used with an indexing barrel 402 where soap foam 122 is directed into a projectile 404 for launching the projectile 404 while carrying the soap foam 122 therein. In this embodiment, as in FIG. 18A, the soap foam generating blaster device 400 includes a projectile shooting body having a sliding inner member 406 within an outer member 408 in similar fashion to embodiments 100, 200, and 300; a grip member 428 with a foreword indexing barrel/cylinder assembly 402. The telescoping body 406, 408 defines a breech chamber 424 therein when in an expanded condition, as can be seen in FIG. 18B, where the telescoping body 406, 408 is releasably retained in this open condition. As the breech 424 is opened, the rotating cylinder 402 is indexed to the next location which contains a projectile 404 pre-loaded therein aligned with the exit port 412 of the soap foam pump 406, 408. The projectile 404 can be made of any materials, such open or closed cell polyurethane foam and the like. In FIG. 18C, while the breech 424 is maintained opened and the telescoping member 406, 408 is temporarily secured in an open condition, soap foam 122 is pumped from a reservoir 414 of soap foam solution 106 through an aerator to create soap foam 122 and then direct it into communication with the foam projectile 404 in the cylinder 402 for firing. As in FIG. 18C, a button 416 can be pressed to actuate the electrically powered pump to pump the soap foam 122 into the foam projectile 404. As can be seen in FIG. 18D, actuation of the inner member by the grip member 406 causes the breech chamber 424 to be collapsed/compressed thereby causing air to launch the projectile 404 from the device 400 launching the projectile 404, loaded with soap foam 122, to a target a distance away from the device.

Figure 21A:
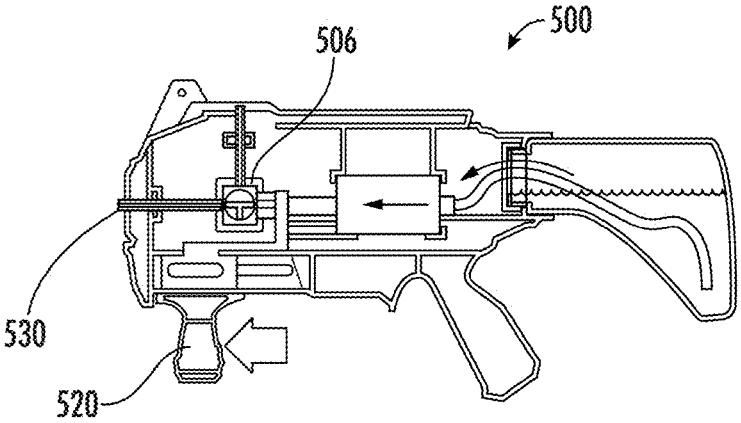
FIGS. 21A and 21B show cross-sectional views of the use of the device of FIGS. 19A, 19B, 20A, 20B in a Mode 1 of operation.
Figure 21B:
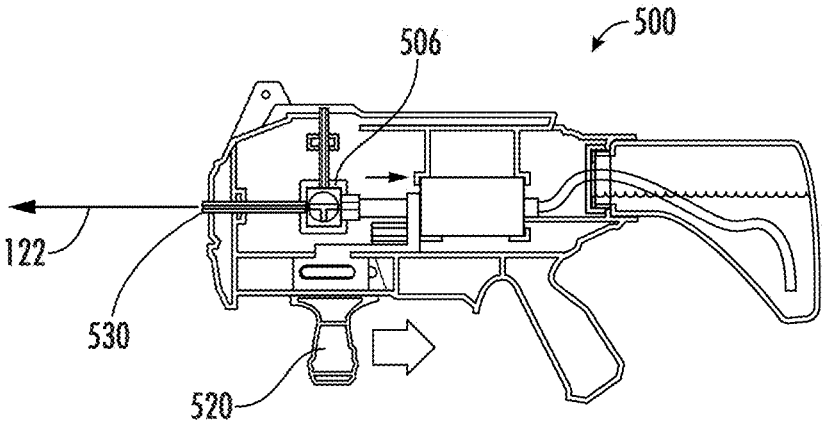

FIGS. 19A, 19B, 20A, 20B show an even further embodiment of the device of FIGS. 18A-D where soap foam is directed into cellular foam projectile. In this further embodiment 500, a motor, indexing mechanism, and secondary piston are not employed. As in the attached figures, this embodiment 500 includes two different firing modes. A primary firing mode, Mode 1 of FIGS. 21A and 21B, uses the mechanism of FIGS. 18A-D, 19A, 19B, 20A, 20B detailed above but uses a nozzle 530 that enables the user to dial their shot with a rotating front plate 502. The dial 502 is positioned to point forward to indicate the direction of generated foam 122 out through a front nozzle 530 to launch the foam 122 freely outside the device after pumping soap foam solution 106 from reservoir 507 (as previously poured from a soap solution bottle 505). Different holes will allow for different streams of foam 122.

Figure 22A:
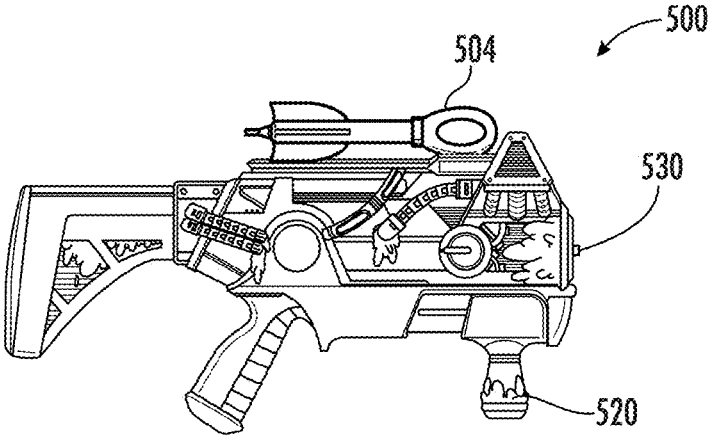
FIGS. 22A-F show further details of the operation of the embodiment of FIGS. 19A, 19B, 20A, 20B in a Mode 1 of operation.
Figure 22B:
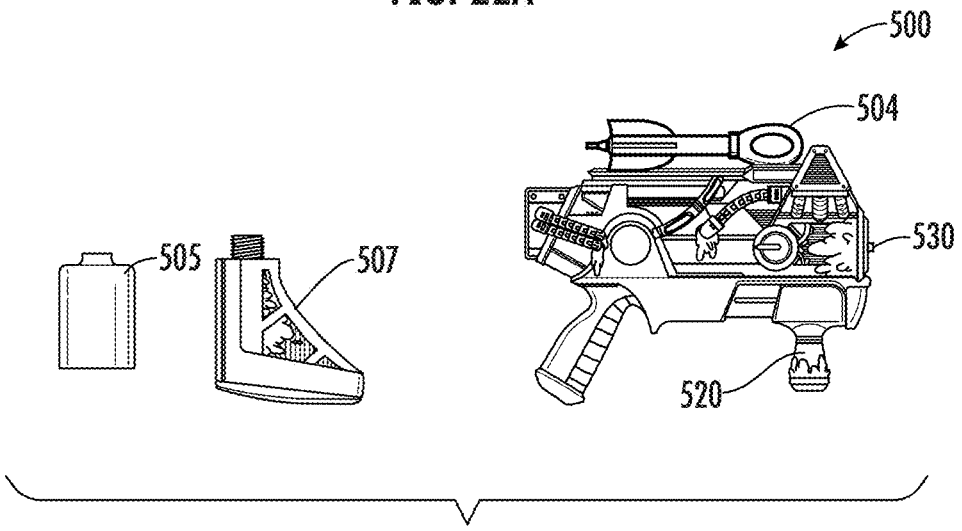
Figure 22C:
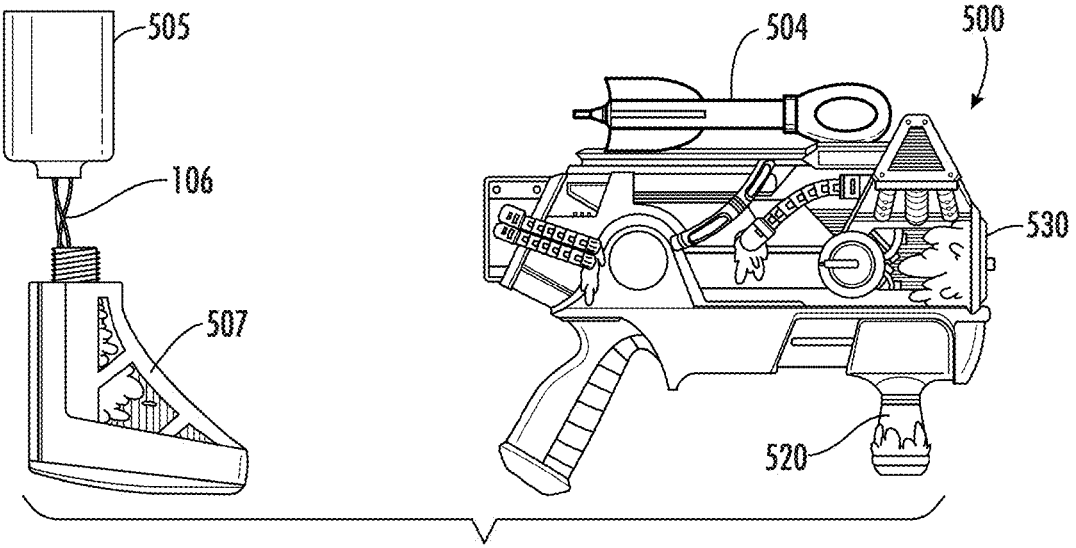
Figure 22D:
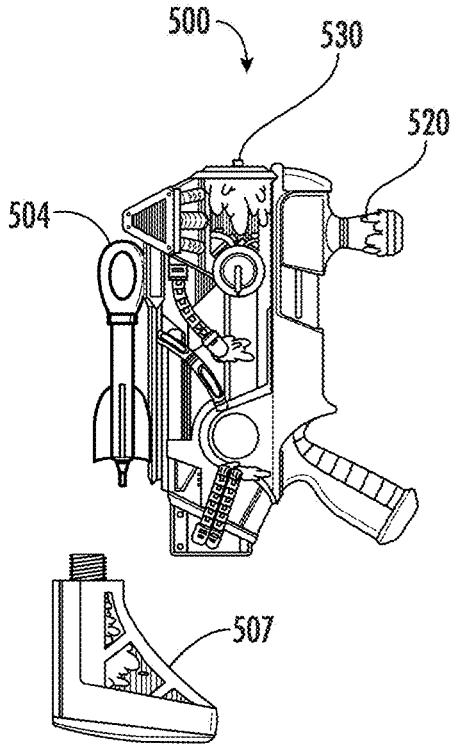
Figure 22E:
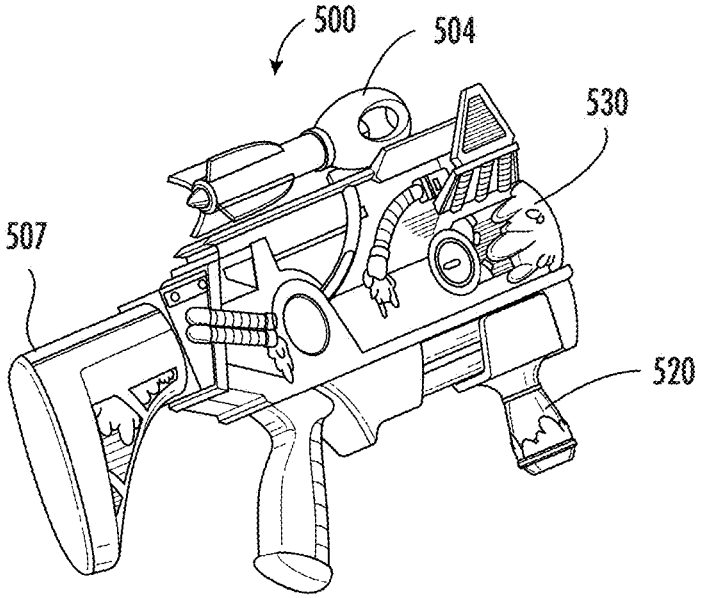
Figure 22F:
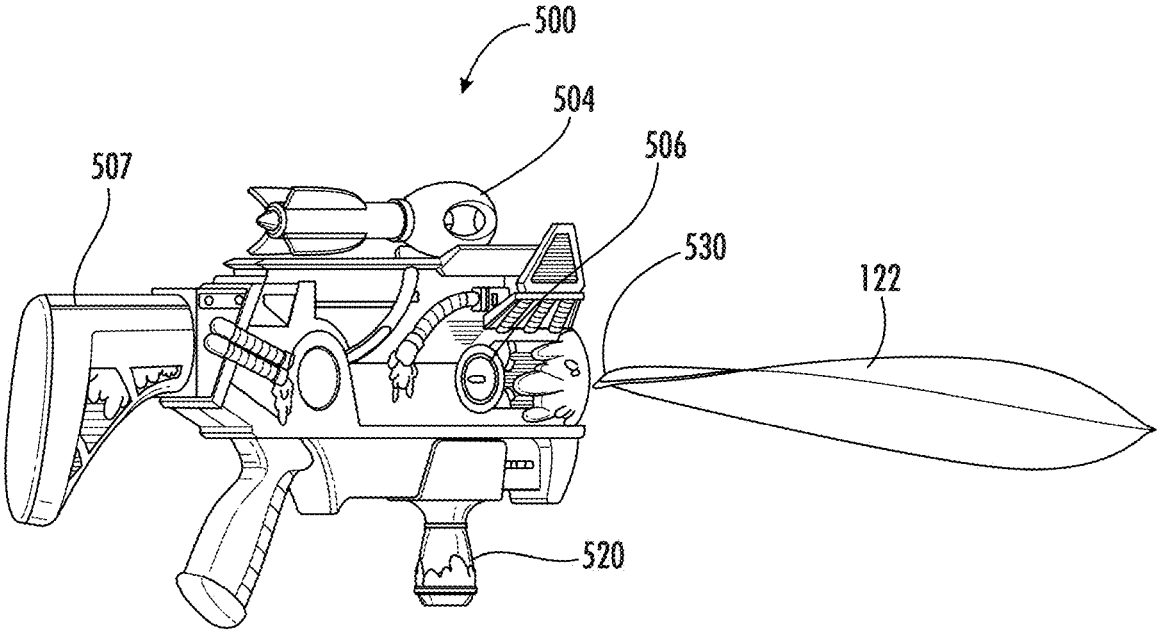

The individual steps of firing Mode 1 can be seen in FIGS. 22A-F. In FIG. 22A, the device 500 is at rest. In FIG. 22B, the reservoir 507 is removed and, in FIG. 22C, the reservoir 507 is filled with soap foal solution 106 from a soap solution bottle 505. In FIG. 22D, the filled reservoir 507 is the process of being reattached to the device 500. FIG. 22E shows the reservoir 507 reattached to the device 500. In FIG. 22F, the handle 520 is pulled to actuate the launching of foam 122 through the outlet nozzle 530. The launching is effectuated by pulling on handle 520 to compress a breech chamber in similar fashion to the other embodiments of the present invention. In mode 1 of embodiment 500, the projectiles 504 are not used.

Figure 23A:
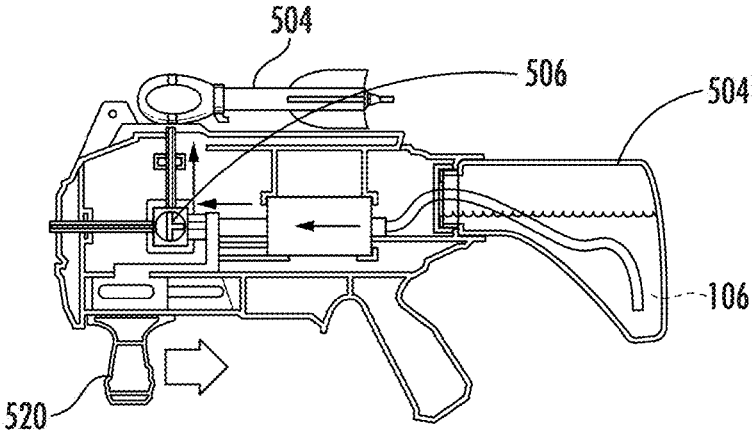
FIGS. 23A-C show various views and details of the use of the device of FIGS. 19A, 19B, 20A, 20B in a Mode 2 of operation.
Figure 23B:
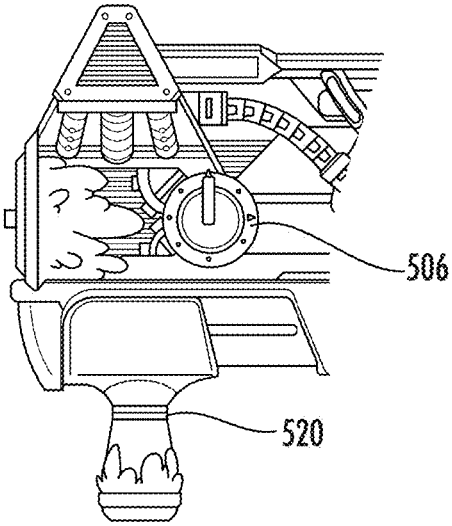
Figure 23C:
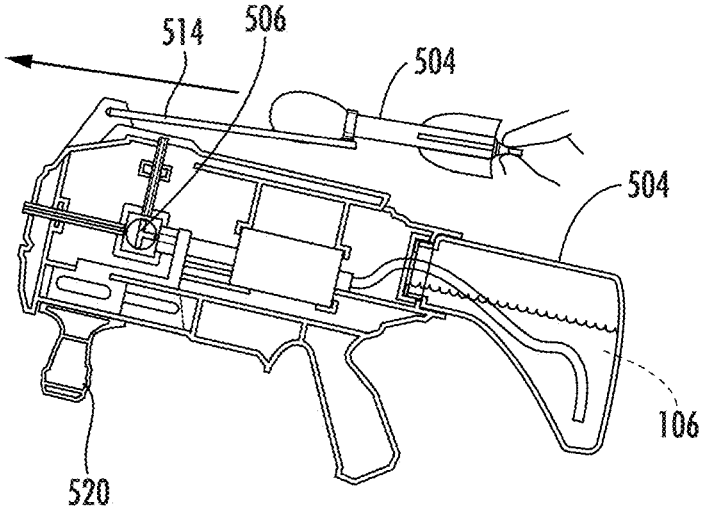
Figure 24A:
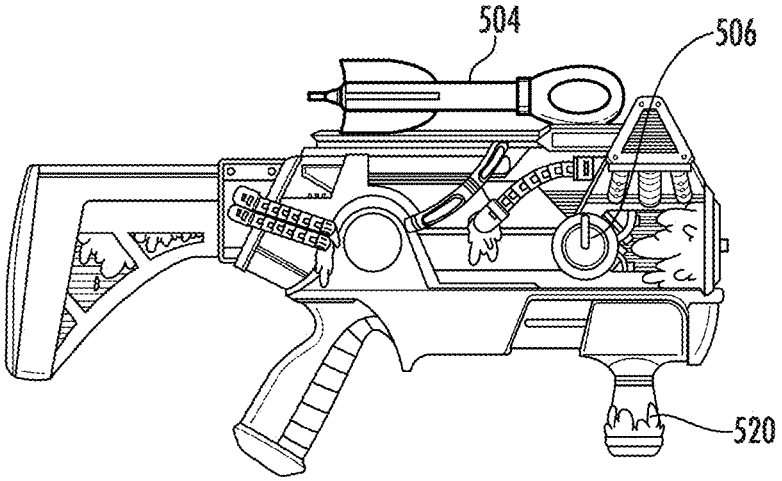
FIGS. 24A-E show further details of the operation of the embodiment of FIGS. 19A, 19B, 20A, 20B in a Mode 2 of operation.
Figure 24B:
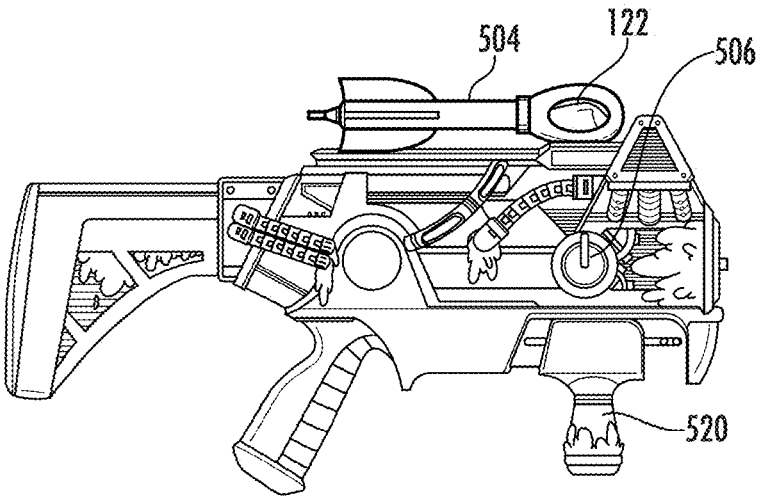
Figure 24C:
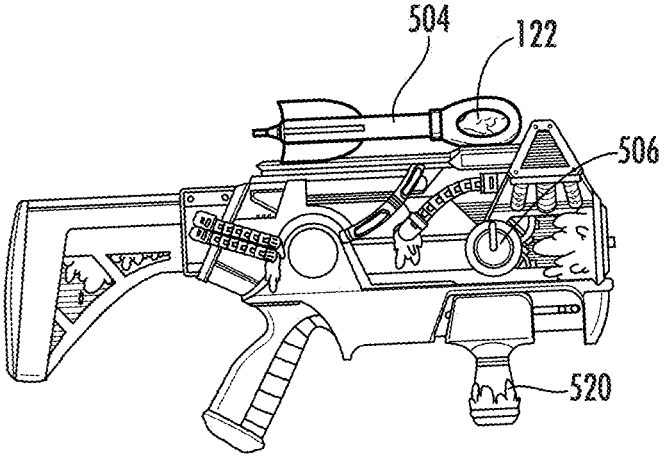
Figure 24D:
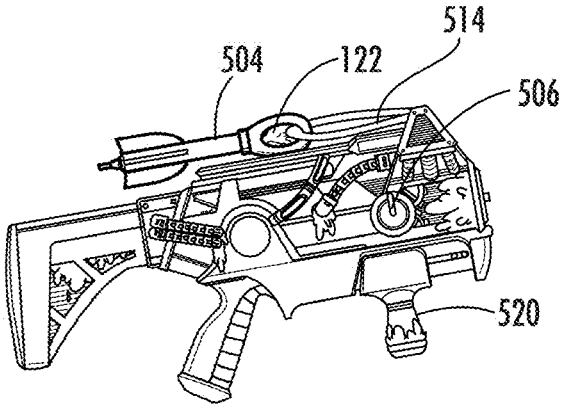
Figure 24E:
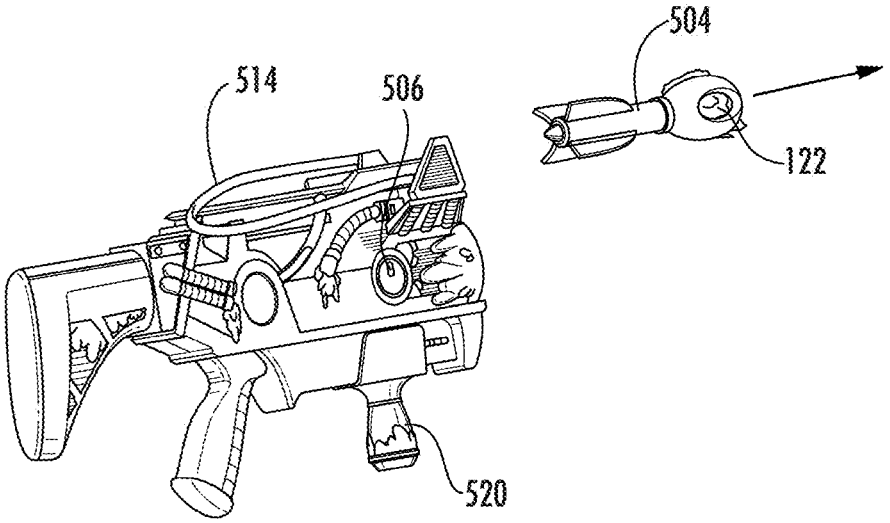

FIGS. 23A-C shows a secondary firing Mode 2 which do use projectiles 504. By turning a dial 506 to point upwards to pump the foam solution 122 upwards, the foam 122 will be directed into the dart heads 504 above, via a nozzle located on top of the blaster 500 to saturate the projectile dart 504 sitting on top of the device 500. Thus, the dial 506 redirects the flow of foam 122 depending on the desired mode of operation. Still referring to Mode 2 of operation, once filled with foam 122 as desired, the projectile darts 504 are then hooked onto a bungee 514 or elastic hoop, loop, or other launching mechanism, so it may be to be flung or launched through the air in a slingshot-like motion when the launching mechanism 514 is released. FIGS. 24A-E show further details of the different steps of Mode 2 operation of the device. For example in FIG. 24A, the dial 506 is rotated to be pointing upward which indicates that the foam 122 will be directed up into a projectile 504 resting on the top of the device 500. In FIG. 24B, the projectile 504 is being filled with soap foam 122. In FIG. 24C, the projectile is fully filled with soap foam 122. In FIG. 24D, the projectile 504 attached to the launching member 514, which can be an elastic band or bungee cord, and is retracted similar to a slingshot. Then, in FIG. 24E, the projectile 504 is launched.

Figure 25:
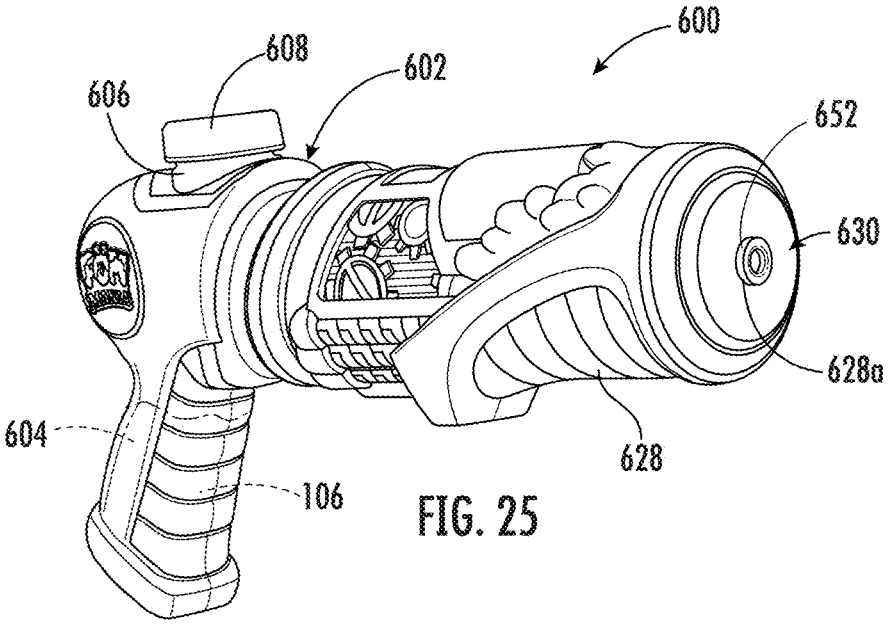
FIG. 25 shows yet another embodiment of the soap foam blaster device of the present invention that includes a manual pump to load and launch the foam.
Figure 26:
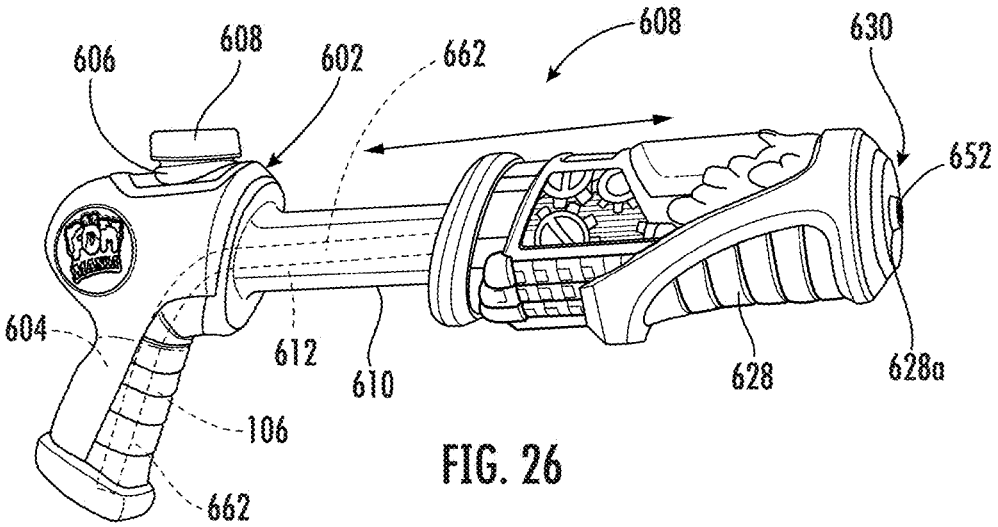
FIG. 26 shows a view of the device FIG. 25 in an extended pump position to load foam in preparation for launch.

Referring now to FIGS. 25-32, another embodiment 600 of the invention is shown and described in detail. This embodiment 600 is generally similar to the embodiment of FIGS. 16, 17A, and 17B in that a manual pump mechanism is used instead of an electrically powered pump. As seen in FIGS. 25 and 26, the device 600 includes a grip member 628 and a main body portion 602 that defines a foam solution storage chamber 604 therein. The soap foam solution 106 is poured in through the top of the device via a top opening 606, which is closed by a cap 608, such a threaded cap 608, or the like. A substantially hollow housing extension 610 is provided through which a dip tube 612 is routed to effectuate pumping of the soap foam solution 106 into a launch chamber 626 via an internal nozzle 314 with a one-way valve 630, as will be described in detail below.

Figure 27:
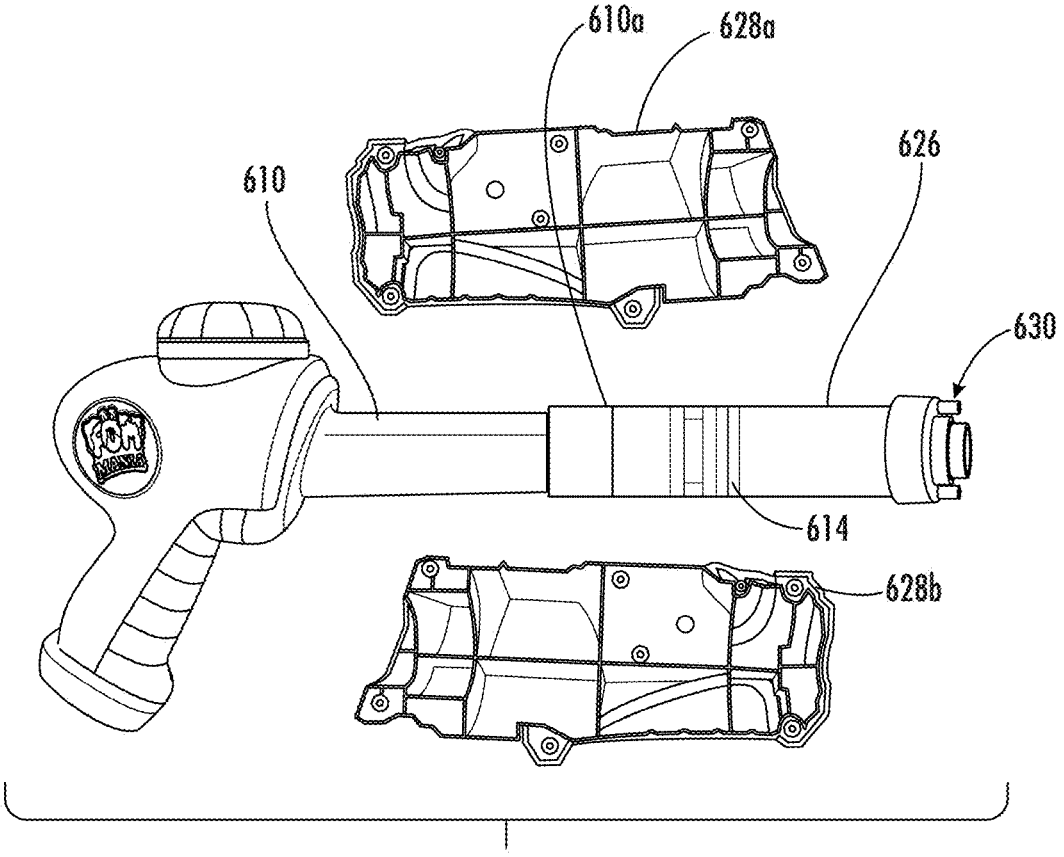
FIG. 27 shows a partially exploded view of the soap foam blaster of FIGS. 25 and 26 with the outer grip housing removed for illustration purposes to show the interior components of the embodiment of the invention.

FIG. 27 shows the embodiment of the soap foam blaster 600 in a partially disassembled condition to include, a telescoping tube 626 that slides back and forth over the housing extension 610*n*. A grip housing 628, such as in the form of two half-housings 628*a*, 628*b*, as shown, is attached to the telescoping tube 626 for ease of grip and manipulation of the telescoping tube 626 namely to facilitate telescoping actuation of the telescoping tube 626 back and forth in relation to housing extension 610. Via the grip housing 628, the telescoping tube 626 is pulled away from the main body portion 602 to extend itself relative to the housing extension 610 to effectively pump or pull soap foam solution 106 through a first inner nozzle 614 and one-way valve 630 to create foam 122 and supply the foam 122 into the foam launch chamber 626. Upon pulling the grip member 628 toward main body portion 602, thereby collapsing the telescoping action of the telescoping tube 626 relative to the housing extension 610, causes the foam 122 to be urged outwardly through the outer nozzle 630 to thereby launch the foam 122 out of the soap foam blaster device 600. The one-way valve 630 in the internal nozzle prevents foam 122 from going back through the internal nozzle 614 and back into the soap foam solution storage chamber 604. Moreover, the one-way valve 631 at the outer nozzle 630 ensures that soap foam 122 can only travel in one direction, namely out of the device 600 for launch. On the other hand, the one-way valve 631 at the outer nozzle 630 is closed when the grip member 628 is being pulled away from the main body portion 602 for pumping soap foam solution 106 up from the solution storage chamber 604. In other words, during manual pumping, it is desired to seal off the outer nozzle 630 as much as possible for increased suction, i.e., optimal pumping of the soap foam solution 106 from the solution storage chamber 604, through the inner nozzle 614 and into the launch chamber 626.

Figure 28:
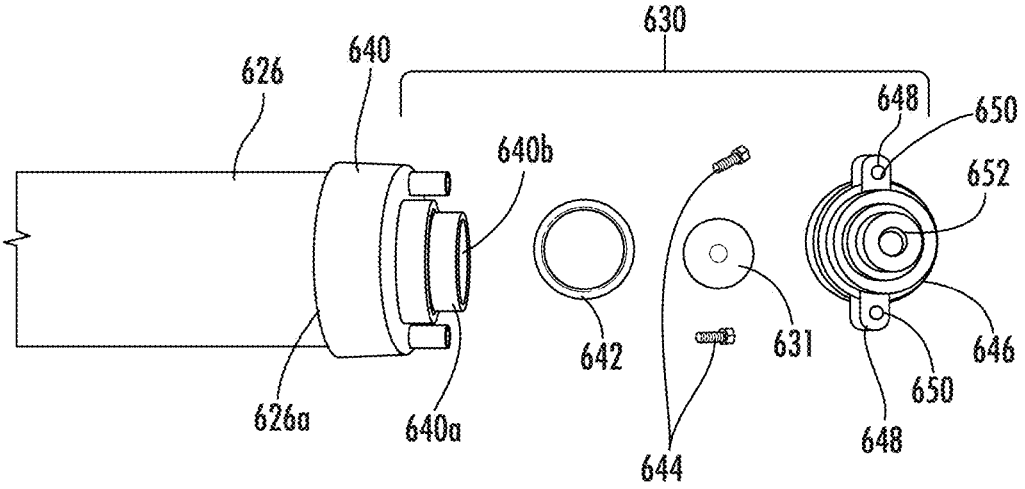
FIG. 28 shows a close up view of the front assembly of the embodiment of FIGS. 25 and 26.
Figure 32:
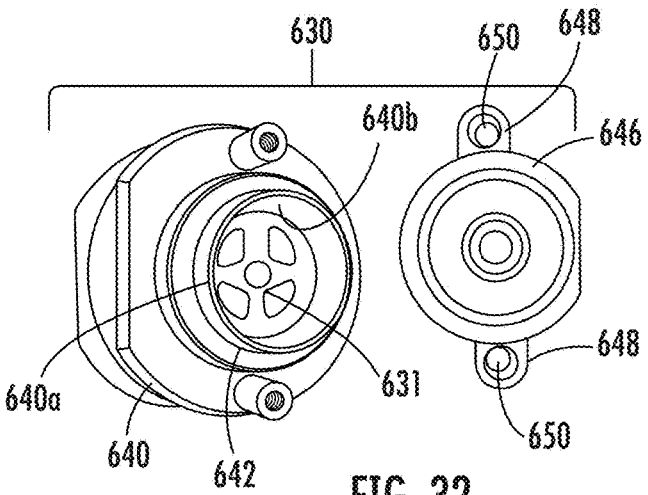
FIG. 32 is a close up perspective view of the nozzle on the free end of the device with one-way valve and cap.

FIG. 28 shows a close up view of the front outer nozzle 630 assembly of the embodiment of FIGS. 25 and 26. A mount cap 640 is secured to the free open end 626*a* of the telescoping tube 626. The mount cap 640 has a boss 640*a* with a bore 640*b* therethrough that receives a gasket 642 thereabout. A one-way valve 631 resides in the bore 640*b* of the mount cap 640. The outer nozzle assembly 630 is attached to the mount cap 640, such as by threaded fasteners 644, pressurizes the outflow of foam 122 so it can be launched at long distances for additional enjoyment of the device. FIG. 32 shows further details of the outer nozzle assembly 630 whereby the gasket 642 can be seen in place about the hollow boss 640*a* and with the one-way valve 631 residing therein. An outer assembly 646 includes, such as, a pair of ears 648 with pass-through apertures 650 to receive fasteners 644, such as threaded fasteners to engage with female threaded apertures on the mount cap. As a result the outer nozzle assembly is secured to the mount cap 640 in sealed fashion with one-way valve 631 captured therein. A supplemental nozzle cap 652 is also provided, which emanates out of a hole 628*a* in the grip member housing 628, as shown in FIGS. 25 and 26. Thus, thus, grip member housing 628 embraces about the telescoping tube 626, mount cap 640, outer assembly 630 and supplemental nozzle cap 652 to make device 600 easier to operate and to make it more aesthetically pleasing.

Figure 29:
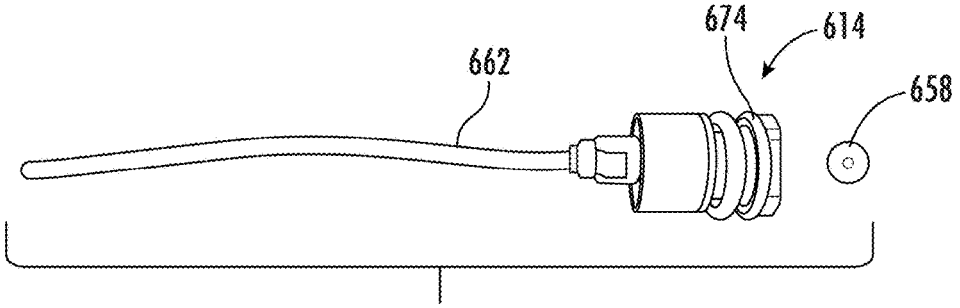
FIG. 29 shows a close up view of the inner mechanical assembly of the embodiment of FIGS. 25 and 26 with one way valve.

Turning now to FIG. 29, a close up view of the inner nozzle assembly 614 of the embodiment of FIGS. 25 and 26. An inner nozzle assembly 614, a close up of which can be seen in FIG. 31, sealingly engages with the open free end 610*a* of the housing extension 610 with the assistance of a plurality of gaskets 656. A one-way valve 658 resides in the inner nozzle assembly 614 to permit the travel of soap foam solution 106 in only one direction, namely up from the solution storage chamber 604, through the inner nozzle 614, the process of which makes foam 122, and then into the launch chamber 626 for launch through the outer nozzle assembly 630.

Figure 30:
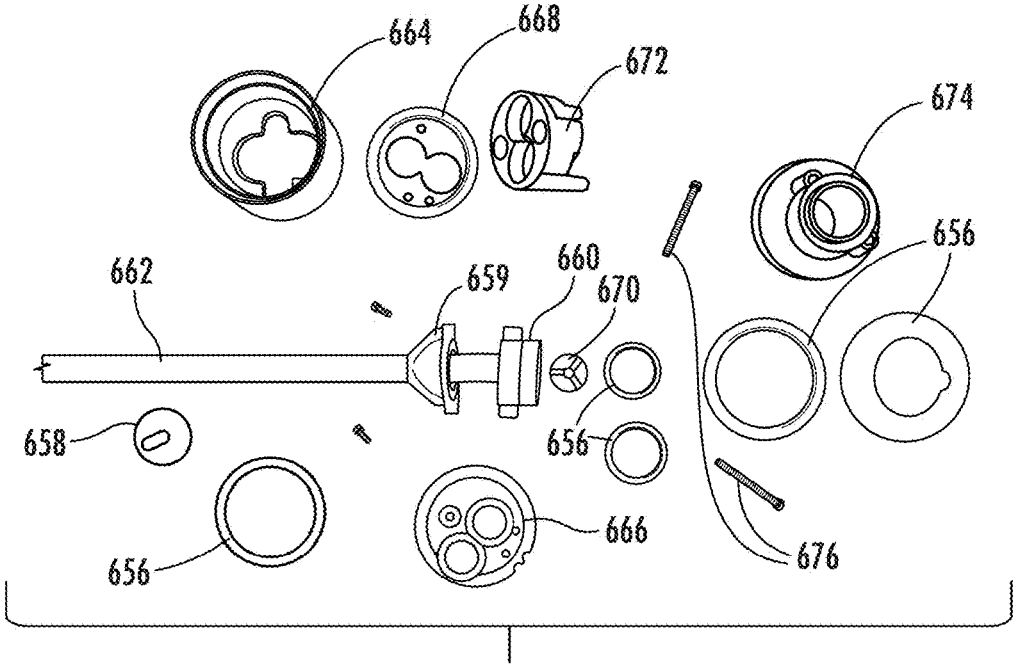
FIG. 30 shows an exploded view of the internal components of the inner assembly of the alternative embodiment of FIGS. 25 and 26.
Figure 31:
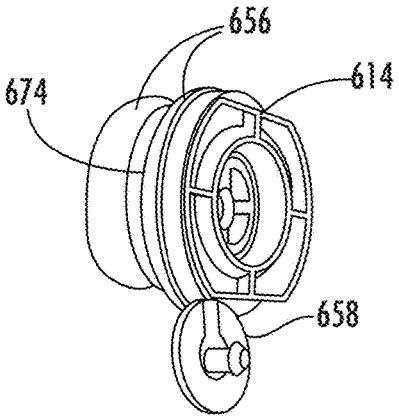
FIG. 31 show a close up perspective view of the inner mechanical assembly of FIG. 29.

FIG. 30, along with FIGS. 29 and 31, show an exploded view of the internal components of the inner assembly 614 at the inner nozzle of the alternative embodiment of FIGS. 25 and 26. A collar 659 and insert port 660 are attached to the free end of the dip tube 662 with a first housing 664 positioned thereabout. An aerator insert 666 resides inside the first housing 664 and against the insert port 660 and is retained in place by a lock plate 668. Gaskets 656 are provided about flow ports on the aerator insert 666 with a flow director 670 residing therein. Intermediary member 672 resides adjacent the lock plate 668 and the inner nozzle end 674 is attached thereto with gaskets 656 residing in circumferential channels 674 defined about the inner nozzle assembly 614. The inner nozzle assembly 614 is retained in assembled form by fasteners 676, such as threaded fasteners.

While the construction of the inner nozzle assembly 614 of FIGS. 29-31 is preferred, it is envisioned that any configuration of an inner nozzle assembly 614 may be employed to carry out embodiment 600 to provide one-way flow of soap foam solution 106 thereacross from a soap foam solution reservoir 604 for the creation of foam 122 within the foam launch chamber 626.

The various structural components of the various embodiments of soap foam blaster device of the present invention disclosed herein are preferably molded plastic, silicone for the tubing for the soap foam solution lines. The motor and other electrical components are made with materials known in the art for such motors and electrical components. As can be understood, the various components shown above are assembled into a completed soap foam generating device. The components of the assembled machine are secured in place, such as by gluing, welding, heat sealing, or the like, to provide the final working machine in accordance with the present invention.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A soap foam generating blaster device, comprising:

a tube body having a sliding inner member that is put under pressure via an elastic material; a grip member with a nozzle on the free end of the tube body; the tube body defining a breech chamber therein where the sliding inner member is either in a resting state or pulled back and put under pressure;

a reservoir of soap foam solution;

a manual pump that pumps soap foam solution through an aerator to create soap foam and directing the soap foam into the breech chamber for pressurization by a sliding piston thereof; and whereby rearward actuation of the inner member by a rear handle causes the sliding piston to come under pressure, whereby releasing the rear handle forces the sliding piston to compress the breech chamber to be collapsed thereby causing the soap foam to be launched from the device to a target a distance away from the device.

2. A soap foam generating blaster device, comprising:

a main housing defining a soap foam solution reservoir;

a housing extension connected to the main housing; an inner valve assembly connected to a free end of the housing extension; the inner valve assembly including an aerator;

a telescoping member that slidably and sealingly actuates relative to the housing extension; an outer nozzle assembly disposed on a free end of the telescoping member; an adjustable foam launch chamber defined within the telescoping member and between the inner valve assembly and the outer nozzle assembly;

a pump configured and arranged from the housing extension and the telescoping member to pump soap foam solution from the soap foam solution reservoir and through the aerator in the inner valve assembly upon outward telescoping and extension out of the telescoping member to create foam in the foam launch chamber; a one-way valve located in the outer nozzle assembly thereby permitting only flow of created foam from the launch chamber and out through the outer nozzle assembly;

whereby inwards telescoping and collapsing in of the telescoping member launches foam through the outer nozzle in pressurized fashion.

3. The soap foam generating blaster of claim 2, further comprising:

a grip member attached to the telescoping member.

4. The soap foam generating blaster of claim 2, further comprising:

a one-way valve in the inner valve assembly permitting only flow of soap foam solution from the soap foam storage chamber, via a dip tube and then through the inner valve assembly and then into the launch chamber in the form of foam.

* * * * *